US006378609B1

(12) United States Patent
Oneal et al.

(10) Patent No.: US 6,378,609 B1
(45) Date of Patent: Apr. 30, 2002

(54) UNIVERSAL WASHDOWN SYSTEM FOR GRAVEL PACKING AND FRACTURING

(75) Inventors: Dean S. Oneal, Lafayette, LA (US); Kevin C. Serrette; Ervin Charlie Becker, III, both of Katy, TX (US); Dhirajlal C. Patel, Carrollton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/455,018

(22) Filed: Dec. 9, 1999

Related U.S. Application Data

(60) Provisional application No. 60/126,855, filed on Mar. 30, 1999.

(51) Int. Cl.[7] ..... E21B 33/12; E21B 43/04

(52) U.S. Cl. ..... 166/278; 166/51; 166/143

(58) Field of Search ..... 166/278, 317, 166/325, 51, 143, 152

(56) References Cited

U.S. PATENT DOCUMENTS

| | | | | |
|---|---|---|---|---|
| 3,926,409 A | * | 12/1975 | Abney et al. | 166/331 X |
| 3,987,854 A | * | 10/1976 | Callihan et al. | 166/278 |
| 4,044,832 A | * | 8/1977 | Richard et al. | 166/278 |
| 4,270,608 A | | 6/1981 | Hendrickson et al. | |
| 4,295,524 A | | 10/1981 | Baker et al. | |
| 4,418,754 A | | 12/1983 | Stepp | |
| 4,428,428 A | * | 1/1984 | Smyrl et al. | 166/278 |
| 4,570,714 A | * | 2/1986 | Turner | 166/278 |
| 4,627,488 A | | 12/1986 | Szarka | |
| 4,633,943 A | | 1/1987 | Zunkel | |
| 4,633,944 A | | 1/1987 | Zunkel et al. | |
| 4,842,057 A | | 6/1989 | Lubitz | |
| 4,871,018 A | | 10/1989 | Caskey et al. | |
| 5,332,038 A | * | 7/1994 | Tapp et al. | 166/278 |
| 5,343,949 A | | 9/1994 | Ross et al. | |
| 5,409,061 A | * | 4/1995 | Bullick | 166/278 |
| 5,507,344 A | | 4/1996 | Young et al. | |
| 5,921,318 A | * | 7/1999 | Ross | 166/250.17 |

OTHER PUBLICATIONS

Eighteen (18) sheets of drawings.

* cited by examiner

*Primary Examiner*—Frank S. Tsay
(74) *Attorney, Agent, or Firm*—Paul I. Herman; Anthony L. Rahhal

(57) ABSTRACT

A universal washdown system for circulating fluid through a wellbore to clean debris therefrom and to gravel-pack a production zone is provided. The system includes a production assembly with a multi-position service tool assembly disposed therein. The multi-position service tool is connected to and sealingly engages a packer that is included in the production assembly. The multi-position service tool assembly moves from a first to a second position in the production assembly by pulling longitudinally thereon. The apparatus is lowered into the well with the service tool connected to the production assembly in the first position. When the service tool assembly is in the second position, fluid passing down through a longitudinal central flow passage defined therethrough is communicated with an annulus defined between a liner assembly and the wellbore through crossover ports defined in the service tool to allow a gravel pack fluid to pass into a desired formation.

34 Claims, 17 Drawing Sheets

UNIVERSAL WASHDOWN SYSTEM FOR GRAVEL PACKING AND FRACTURING

This application claims the benefit of U.S. Provisional Application No. 60/126,855 filed on Mar. 30, 1999.

BACKGROUND OF THE INVENTION

This invention relates to a tool for use in gravel packing wells. More specifically, the invention relates to a washdown apparatus which can remove wellbore debris by circulating a fluid down the work string and carrying the debris up the casing or by circulating a fluid down the casing, picking up the debris and carrying it up the bore of the assembly and through the work string, so that the wellbore can be cleaned and gravel packed with the same tool, thus reducing the number of trips in the hole to complete the gravel pack operation. The term "gravel pack" may mean high rate, water rate, frac pac, or other stimulation operation involving placement of sand or synthetic proppant in the target formation/casing annulus.

In wells in geologic formations where the production of sand from the formation along with liquids and gases being produced therefrom is a problem, it is well known in the art to install a production screen in the production tubing and pack gravel around the screen to prevent the sand from the formation flowing in the production tubing. Hereinafter "well screen" or "production screen" means any well filtration device intended to inhibit the flow of sand, or other fines into the production tubing, such as a screen, slotted liner, perforated pipe or sintered metal tube.

In such an arrangement a gravel pack screen assembly is run into the formation on a string of tubing to the desired location and a slurry containing gravel, which is typically gravel sand or proppant mixed in water or a gelled liquid, is pumped down to the exterior of the gravel pack screen assembly to fill the area between the screen assembly and the producing formation. After a sufficient amount of gravel has been pumped down to the exterior of the gravel pack screen assembly to completely fill he area between the screen assembly and the producing formation, the service tool is removed from the well and production tubing is installed.

Very often a wellbore will have debris that must be removed prior to completing the gravel pack operation. Such debris, if not removed, can cause the gravel packing process to be temporarily aborted. In other words, if the debris remains in the wellbore, the gravel pack assembly would have to be removed and the debris circulated out of the well with a different tool prior to the completion of the gravel pack process. Influx of formation debris can occur during necessary pipe trips, which would again necessitate cleaning of the wellbore before the gravel pack assembly was installed. Typically, to avoid such problems, fluid is circulated down a work string and up through the annulus between the work string and the wellbore until the wellbore is sufficiently free from debris so that the gravel packing operation can be performed. The work string is then removed and the gravel pack assembly is lowered into the wellbore.

SUMMARY OF THE INVENTION

The foregoing difficulties are eliminated according to a preferred embodiment of the present invention by a universal washdown system, or apparatus, which can be used both to circulate fluid through a wellbore to clean debris therefrom and can be used to gravel pack a production zone. The system comprises a production assembly and a multi-position service tool assembly disposed in the production assembly. An annulus is defined between the side of the wellbore and the production assembly. The production assembly may include a packer for sealingly engaging the wellbore and for suspending the production assembly therein, and a liner assembly having a longitudinal liner bore defined therethrough extending downward from the packer. The multi-position service tool assembly is releasably attached to the packer and sealingly engages a packer bore defined in the packer. The service tool has a longitudinal central flow passage extending therethrough. At least one crossover port, and preferably a plurality of crossover ports are defined through a side of the service tool and intersect the longitudinal central flow passage.

The multi-position service tool assembly is movable from a first position to a second position in the production assembly. When the washdown apparatus is lowered into the well, the service tool is releasably connected to the production assembly in the first position. The crossover ports are sealingly engaged by the liner when the tool is in the first position so that no flow is allowed therethrough. The central flow passage is communicated with the wellbore through a lower end of the production assembly. Thus, fluid flowing down the central flow passage will exit the production assembly at a lower end thereof and will pass into the wellbore. Likewise, fluid can be displaced down the annulus between the production assembly and the wellbore as the apparatus is being lowered into the wellbore. The fluid will enter the lower end of the production assembly and pass upward through the longitudinal central flow passage of the service tool assembly into the work string thereabove until it reaches the surface.

The service tool is slidable in the production assembly from the first position to the second position by pulling longitudinally thereon. Flow ports defined in the liner assembly are located above the crossover port when the service tool is in the first position. When the tool is in the second position, the crossover port is communicated with the flow ports defined through the liner. Thus, when the service tool assembly is in the second position, fluid passing down through the central flow passage can pass through the crossover port and the flow ports in the liner so that the central flow passage is communicated therethrough with the annulus defined between the liner assembly and the wellbore.

The apparatus further includes tool retaining means for retaining the service tool in the second position. The apparatus is run into the well in the first position so that fluid can be circulated through the longitudinal central flow passage and the annulus between the apparatus and the wellbore to clean out any debris in the wellbore. Once the wellbore has been cleaned, a production screen connected in the liner assembly is positioned adjacent a production zone and the packer is set. The service tool is then pulled upward into the second position and is retained in the second position by the tool retaining means.

A wash shoe may be attached to a lower end of the production assembly. The wash shoe may include an outer shoe housing attached to the liner assembly below the production screen. An inner sleeve is slidably disposed in and releasably attached to the outer shoe housing. The inner sleeve has a bore communicated with the central flow passage and has a plurality of ports defined therethrough. When the service tool is in the first position, the ports in the inner sleeve communicate the longitudinal central flow passage with a lower exit opening defined on the outer shoe housing. The lower exit opening comprises the lower end of the production assembly. A wash pipe stinger disposed at the lower end of the service tool is releasably connected to the inner sleeve. When the service tool assembly is pulled longitudinally from the first position to the second position, the inner sleeve of the wash shoe is pulled longitudinally to a closed, or sealed position. In the closed position, the inner sleeve seals against the outer shoe housing, so that the ports defined therethrough are blocked and no communication is allowed through the lower end of the production assembly. The wash pipe stinger is releasably attached to the inner sleeve so that as the service tool assembly is pulled longitudinally, the wash pipe stinger will detach from the inner sleeve. The shoe includes a shoe retaining means for retaining the inner sleeve in the sealed position. Thus the inner sleeve may be positively locked so it cannot slide downward back into the open position. When the service tool assembly is in the second position, the lower end of the wash pipe stinger is preferably adjacent the production screen.

The invention also includes a multi-piece drop dart which comprises a setting means for setting the packer and a sealing means for sealing the central flow passage to prevent downward flow therethrough below the crossover port. The multi-piece drop dart has an outer setting sleeve that will engage an opening sleeve disposed in the service tool assembly. As fluid pressure is applied through the longitudinal central flow passage, the setting sleeve will cause the opening sleeve to slide downward. When the opening sleeve slides downward, the central flow passage will be communicated with a piston that will hydraulically set the packer. The multi-piece drop dart further includes a sealing dart releasably attached to the outer setting sleeve. Increased fluid pressure will cause the sealing dart to be detached from the outer setting sleeve. The sealing dart will pass downward through the central flow passage and will engage a crossover seat defined in the service tool assembly below the crossover port. The sealing dart will prevent downward flow through the central flow passage below the crossover port. Finally, as fluid pressure increases, a closing ball, which is releasably connected to the sealing dart, will detach and will engage a ball seat disposed in the service tool below the crossover seat.

Once the packer has been set, the service tool can be pulled upward into the second position, which will move the wash shoe into the closed position, and a gravel pack fluid can be displaced down the central flow passage. Because the sealing dart has engaged the crossover seat, the gravel pack fluid will pass through the crossover ports in the service tool and the flow ports defined in the liner assembly. The gravel pack fluid will pass downward in the annulus between the production assembly and the wellbore. The gravel pack fluid will continue to be displaced until a sufficient amount of gravel or proppant is placed in the formation and around the production screen. The liquid used to displace the gravel can pass into the formation, and is also communicated with the central flow passage through the production screen and the wash pipe stinger which is preferably positioned adjacent the production screen when the service tool assembly is in the second position.

BRIEF DESCRIPTION OF THE DRAWINGS

FIGS. 9A and 9B are views, partially in section and partially in elevation of the telescoping joint of the present invention.

DETAILED DESCRIPTION OF A PREFERRED EMBODIMENT

Figure 1A:
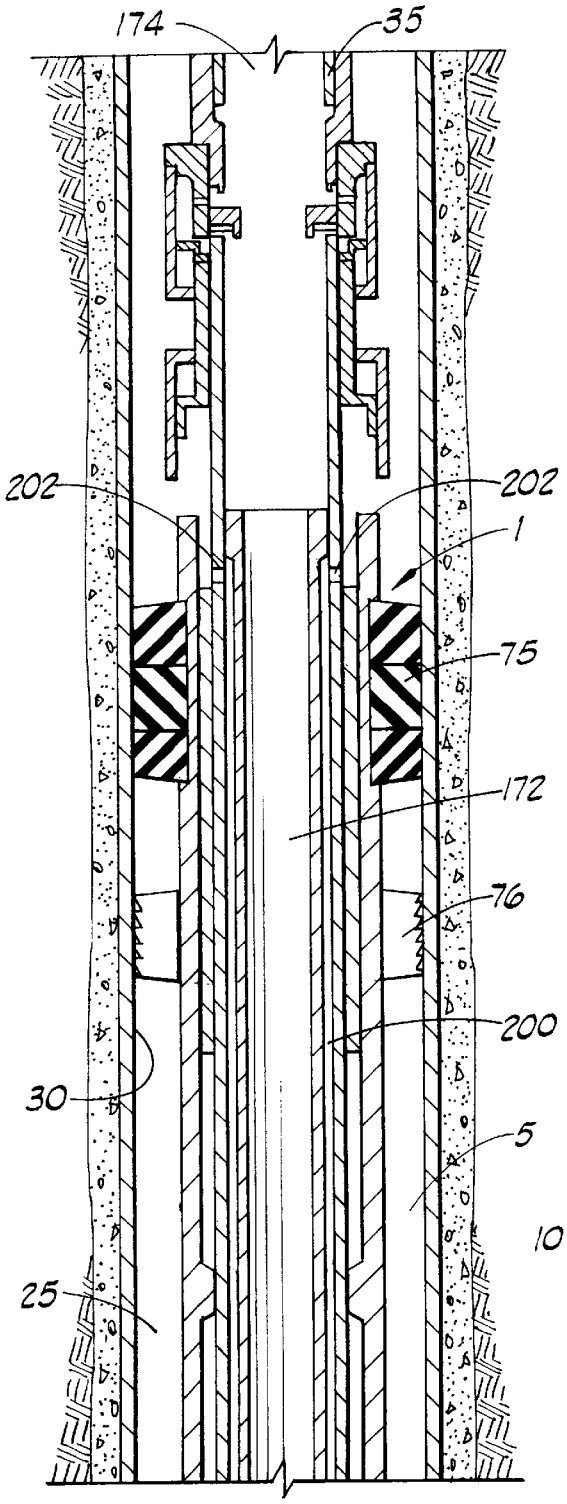
FIGS. 1A and 1B schematically show a section view of the apparatus of the present invention disposed in a wellbore with the service tool in its second position.

In the description that follows, like parts are marked throughout the specification and drawings with the same reference numerals, respectively. The drawings are not necessarily to scale and the proportions of certain parts may have been exaggerated to better illustrate the details and features of the invention.

It is to be understood that although the invention is presented in the context of a gravel pack system in gravel packing a well, it is not necessary that a gravel pack job be performed, and other jobs, such as fracturing a formation can be performed with the invention of the present application.

Figure 1B:
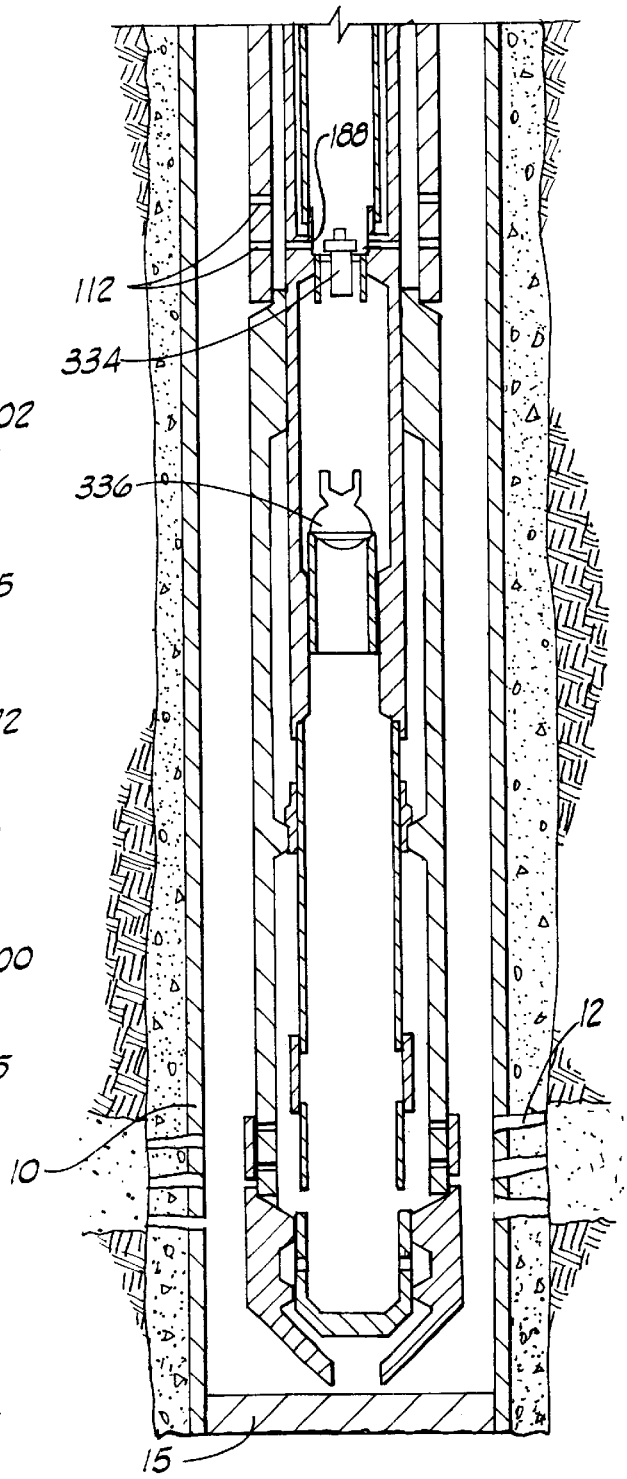

Referring now to the drawings and more particularly to FIGS. 1A and 1B, a universal washdown system, or apparatus 1 is schematically shown suspended in a wellbore 5. The wellbore may include a casing 10, and may have a bridge plug 15 installed below a production zone 20. Casing 10 may include perforations 12 positioned adjacent the production zone 20. An annulus 25 is defined between washdown system 1 and the side 30 of the wellbore 5. Apparatus 1, which may be connected to a work string 35 thereabove, includes a production assembly 40 having a multi-position service tool 45 disposed therein.

The production assembly includes a packer 50 and a liner assembly 55 extending downward therefrom. FIG. 1 schematically shows the packer expanded so that it sealingly engages the casing 10 thus suspending the production assembly in the wellbore. A wash shoe 60 is threadedly connected to a lower end 57 of the liner. A production screen 65 is included in the liner assembly and the wash shoe 60 is connected in the liner below the production screen 65. Packer 50 includes a packer mandrel 72, which defines a packer bore 74 and an outer packer mandrel 20 concentrically disposed thereabout which is adapted to carry sealing elements 75 and a slip carrier assembly 76. Slip carrier assembly 76 includes slips 78 and slip expanders 80 and 80A. A seal expander 82 and seal retainer 82A are also included.

Service tool 45 is releasably connected to packer 50 with shear pins 84, and is thus releasably connected to production assembly 40. Packer mandrel 72 has a lower end 98. Packer 50 is connected to a tubular bottom sub 88, which has an inner diameter 89, by a release coupling assembly 90 which includes a stop ring 92, a shifting sleeve 94 and a shear sleeve 96.

Liner assembly 55 is connected to packer assembly 50 by tubular bottom sub 88 and extends downward therefrom. Liner 55 includes an upper liner extension or upper portion 100 having a liner bore 101 defined therethrough, a seal or center portion 102 connected to and extending downward from upper liner extension 100 and a lower liner portion 104 extending downward from seal portion 102. Lower liner portion 104 has a lower liner bore 105 defined therethrough and may be connected to seal portion 102 with a threaded adapter 106. Seal portion 102 defines a seal bore 108. The production assembly thus has a longitudinal opening defined therethrough. The diameter of seal bore 108 is substantially identical to the diameter of packer bore 74 and inner diameter 89 defined on tubular bottom sub 88.

An annular flow passage 110 is defined between service tool 45 and upper liner bore 101, which has a greater diameter than seal bore 108. Upper liner extension 100 has a plurality of flow ports, or liner ports, 112 defined therethrough intersecting annular flow passage 110 thus communicating annular flow passage 110 with the annulus 25 defined between the liner 50 and the side 30 of wellbore 5.

Lower liner 104 comprises a plurality of tubular members 116 which may be connected together with threaded couplings or by any means known in the art. An annulus 114 is defined between lower liner bore 105 and service tool 45. A latch receptacle 117, comprising radially inwardly extending squeeze shoulder 118 having an inner diameter 119 is defined on lower liner portion 104. Squeeze shoulder 118 may also be referred to as collet indicator 119. Latch receptacle 117 is connected in the liner at its upper and lower ends to tubular members 116. Service tool 45 is closely received in inner diameter 119. Lower liner portion 104 may have a safety joint 121 threadedly connected therein. Safety joint 121 may include an internal portion 122 slidably and sealably positioned within the bore of an external portion 120 and secured in place by a shear screw 124. External portion 122 is threadedly connected at its upper end to a tubular member 116. Internal portion 120 extends downwardly therefrom and will be threadedly connected at its lower end to a tubular member 116 so that the liner continues to extend downwardly therefrom. As is well known in the art and apparent from the drawings, the members identified as the tubular members 116 are tubular pieces which may vary in length and thickness and which will remain in the wellbore after gravel packing as part of the production string. Liner 104 may include couplings 113 to threadedly connect tubular members 116 and other components of the liner together.

The liner assembly may include a perforated pipe 126 at the lower end thereof to allow flow therethrough so that production screen 65 comprises perforated pipe 126 and a screen "5" disposed thereabout. Wash shoe 60 is connected to screen 65 at threaded connection 125.

In the embodiment shown, a hydraulic packer setting tool 150 is disposed about service tool 45 above hydraulically set packer 50. Persons skilled in the art will recognize that any suitable well packer may be employed in this application without regard to the means or method employed to set the packer, which, by way of example and not by means of limitation, may include mechanical, hydraulic or electric line actuated setting devices. Setting tool 150 may include a piston 152 sealingly disposed in a chamber 154 defined between a cylinder portion 155 of setting tool 150 and service tool 45. A setting arm 156 is disposed about the service tool below the piston. The method and operation by which the setting tool is operated and by which the packer and slip joints are set will be described further hereinbelow and are described in U.S. Pat. No. 5,343,949 to Ross et al., issued Sep. 6, 1994, U.S. Pat. No. 5,103,902 to Ross et al., issued Apr. 14, 1992, and U.S. Pat. No. 4,832,129 to Sproul et al., issued May 23, 1989, the details of all of which are incorporated herein by reference.

Service tool 45 includes a service tool mandrel 140 having a service tool adapter 142 threadedly connected thereto. Service tool adapter 142 has an upwardly facing tapered shoulder 143 defined therein and is threadedly connected to a work string adapter 144 having threads adapted to be connected to work string 35 thereabove. An opening sleeve 158 is shearably attached to service tool adapter 142 with cove vents 160. Opening sleeve 158 includes a frustoconical seat portion 159 and a lower end 161.

A longitudinal central flow passage 172 is defined through service tool 45 and is communicated with a bore 174 of work string 35 as schematically shown in FIG. 1. As previously described, the service tool is releasably connected to the packer with shear pins 84. Service tool mandrel 140 includes a head portion 178, a middle portion 180 threadedly connected to and extending downward from head portion 178, and a lower portion 181 threadedly connected to and extending downward from middle portion 180. A plurality of annular seal rings 182 are disposed about middle portion 180 in longitudinally spaced recesses. Middle portion 180 has an outer diameter 184. Outer diameter 184 and seals 182 are closely received in and sealingly engaged by packer bore 74, inner diameter 89 of tubular member 88 and seal bore 108.

Middle portion 180 has a crossover piece 186 threadedly connected therein. Crossover piece 186 has crossover ports 188 defined therethrough which intersect central flow passage 172. An inner bore 176 is defined on middle portion 180 above crossover piece 186. Crossover piece 186 has an outer diameter 189 which forms a part of and is substantially identical to outer diameter 184. Crossover piece 186 has a first crossover bore 183 and a second crossover bore 185 defined therein below crossover ports 188. A frustoconical crossover seat 187 is defined between bores 183 and 185. When service tool 45 is in the position shown in FIGS. 2A–2O, which is referred to as a first position 191, crossover piece 186 is positioned in seal bore 108 of liner assembly 55. As provided herein, the diameter of seal bore 108 is substantially identical to packer bore 74. Seals 182 engage seal bore 108 above and below crossover ports 198 and thus circumscribe ports 188 so that in first position 191 communication cannot be established and is not allowed through crossover ports 188.

A service tool inner sub 190 is disposed in inner bore 176 above crossover piece 186. Service tool inner sub 190 has an upper end 192 which sealingly engages inner bore 176, and is connected at a lower end 194 to a threaded upper extension 195 defined on crossover piece 186. An outer surface 198 defined on service tool inner sub 190 has a diameter smaller than inner bore 176 so that an annular return passageway 200 is defined between service tool inner sub 190 and inner bore 176 above crossover piece 186. A lateral return port 202 is defined through middle portion 180 of service tool 45 and intersects annular return passageway 200. In first position 191, lateral return port 202 is positioned in packer bore 74 with seals 182 thereabove and therebelow so that flow therethrough is prohibited.

Figure 11:
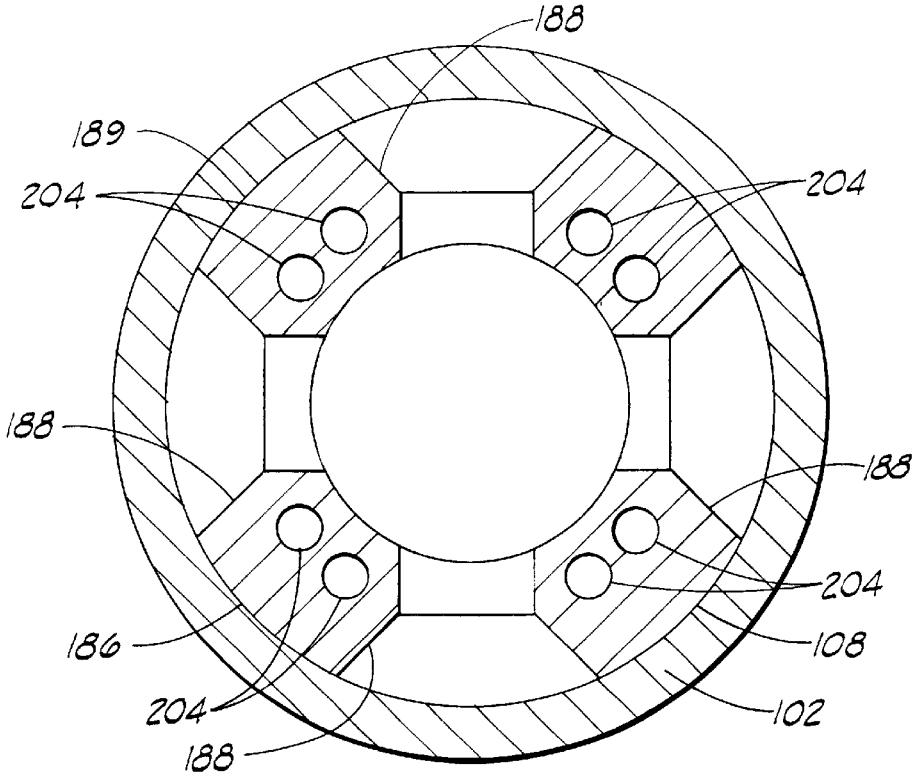
FIG. 11 is a cross-sectional view taken from line 11—11 of FIG. 2F.
Figure 12:
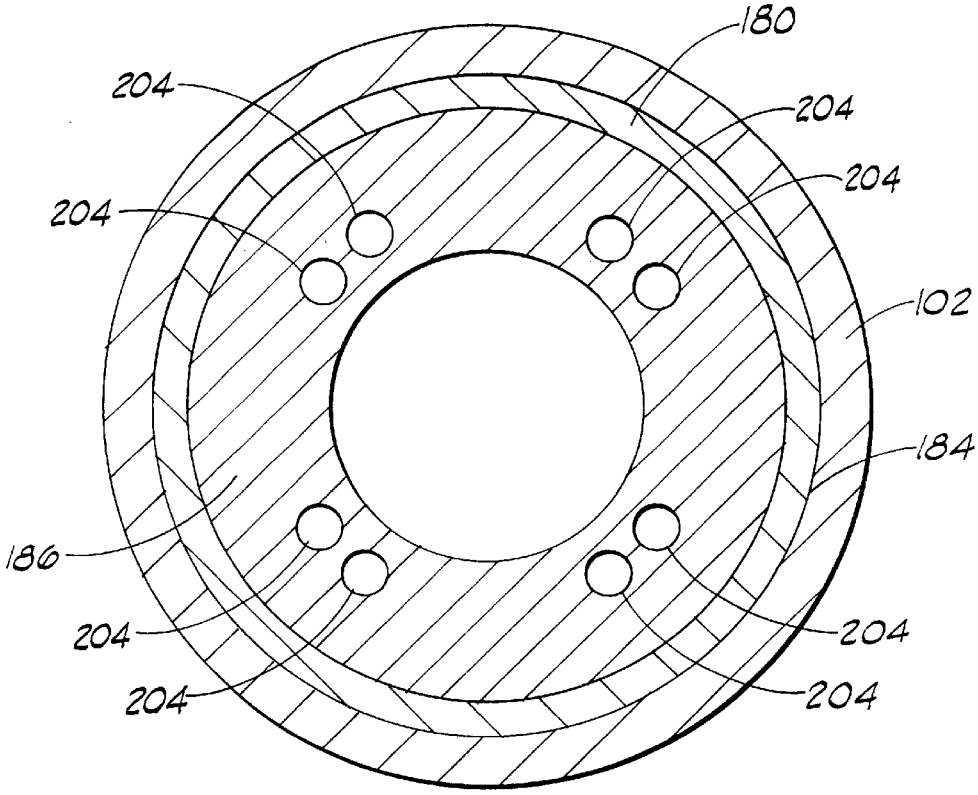
FIG. 12 is a cross-sectional view of the crossover taken along line 12—12 of FIG. 2G.

As shown in FIGS. 11 and 12, crossover piece 186 further includes a plurality of longitudinal return ports 204 defined therethrough. The longitudinal return ports 204 extend longitudinally through crossover piece 286 and thus communicate the portion of central flow passageway 172 below crossover piece 186 with annular return passageway 200.

Middle portion 180 extends downward from crossover piece 186 and may include any number of threadedly connected tubular extensions 203 to achieve the desired length. Middle portion 180 has a lower end 206 threadedly connected to a ball catcher sub 208 which forms a part of lower portion 181. A snap ring 210 is disposed about ball catcher sub 208. The snap ring is held in place by shear screw carrier 212 which has a shear screw 213 extending therethrough into ball catcher sub 208. A cylindrical ball seat 214 having an outer diameter 215 and an upper end 217 is sealingly disposed and releasably attached in an inner diameter 216 of ball catcher sub 208, with a lug 218 which extends through shear carrier 212 and ball catcher sub 208 into ball seat 214. The lug extends through a longitudinal slot 219 defined in ball catcher sub 208 so that the lug and thus ball seat 214 and carrier 212 move longitudinally with respect to ball catcher sub 208 when shear screw 213 breaks. Longitudinal slot 219 has a lower end 221. A plurality of lateral ports 223 are defined through ball seat 214 above inner diameter 216 of ball catcher sub 208.

Figure 14:
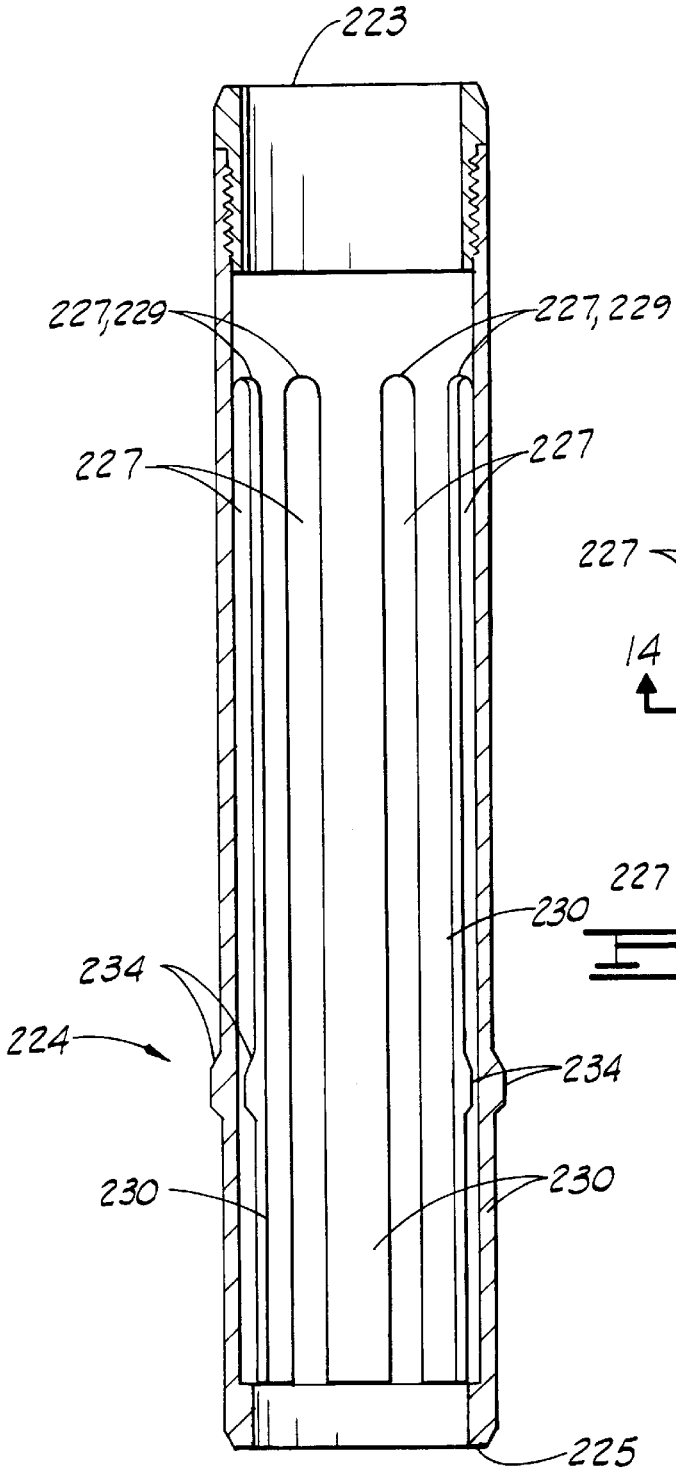
FIG. 14 is a top view of the collet of the present invention.
Figure 13:
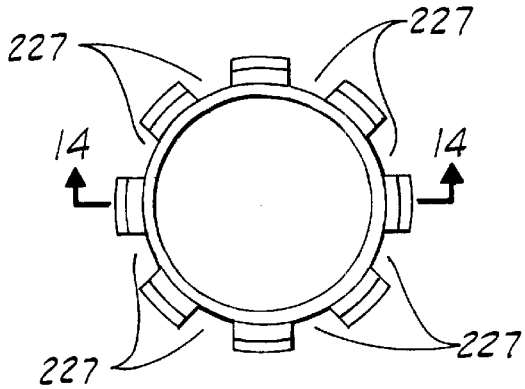
FIG. 13 is an elevation section view of the collet of the present invention.

A threaded adapter 220 is connected to and extends downward from ball catcher sub 208. A collet joint 222 is threaded to and extends downward from adapter joint 220. A collet 224 is disposed about collet joint 222. As shown in FIGS. 13 and 14, collet 224 is a double-ended collet. In first position 191, collet 224 is positioned below collet indicator 118 which is defined on liner assembly 55. Collet joint 222 includes a radially outwardly stepped shoulder 226 defined on an outer surface 228 thereof. Collet 224 has an upper end 223, a lower end 225 and includes a plurality of collet fingers 230 each having a radially outwardly projecting latching heads or locking heads 234 defined thereon. The collet included a plurality of slots 227 which define fingers 230. Slots 227 have an upper end 229 and extend to lower end 223 of collet 224. Collet fingers 230 are disposed about radially outwardly stepped shoulder 226. A wash pipe 236, which includes a plurality of tubular joints connected together and which may be of any desired length may be connected to collet joint 222 with an adapter 235. Wash pipe 236 further includes a telescoping assembly 238 having an upper end 240 and a lower end 242, and a circulation valve 244 connected therein. Circulation valve 244 has an upper end 246 and a lower end 248. An adapter 250 connected to the lower end of circulation valve 244 has a wash pipe stinger 252 threadedly connected thereto and extending downward therefrom. Wash pipe stinger 252 is sealingly received in wash shoe 60 and has a lower end 254.

Figure 2A:
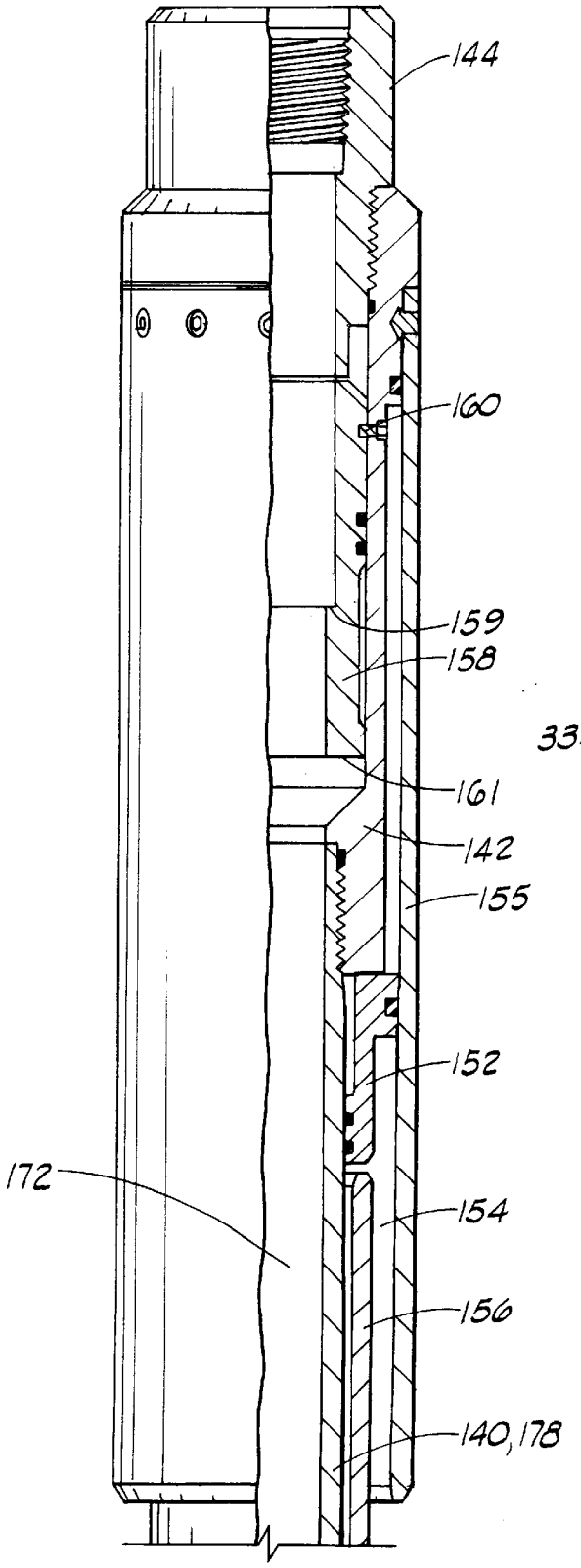
FIGS. 2A–2O are views, partially in section and partially in elevation, of the apparatus of the present invention with the service tool in the first position.
Figure 2B:
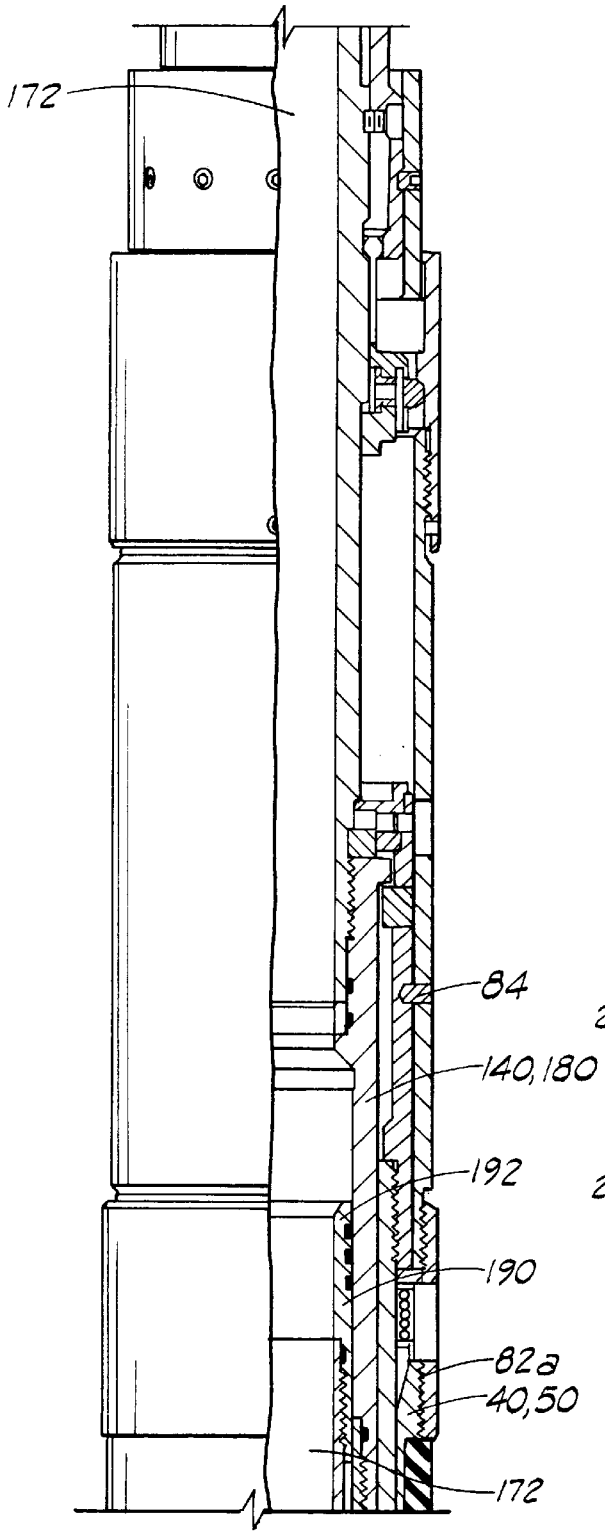
Figure 2C:
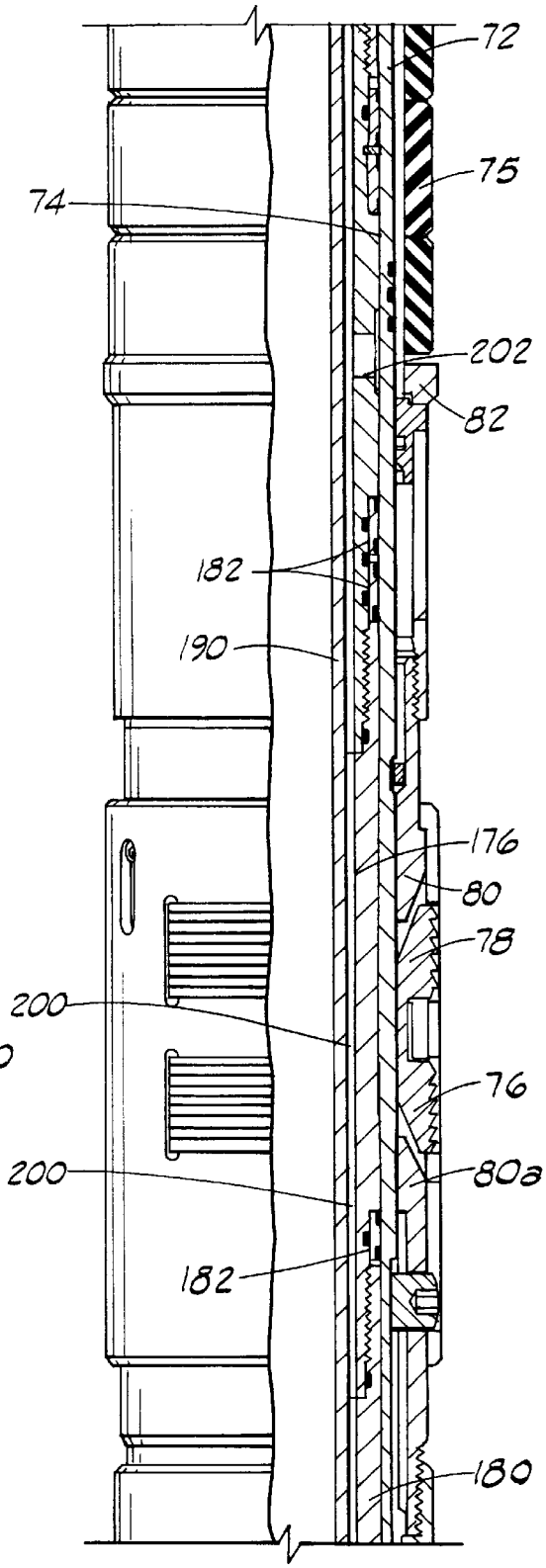
Figure 2D:
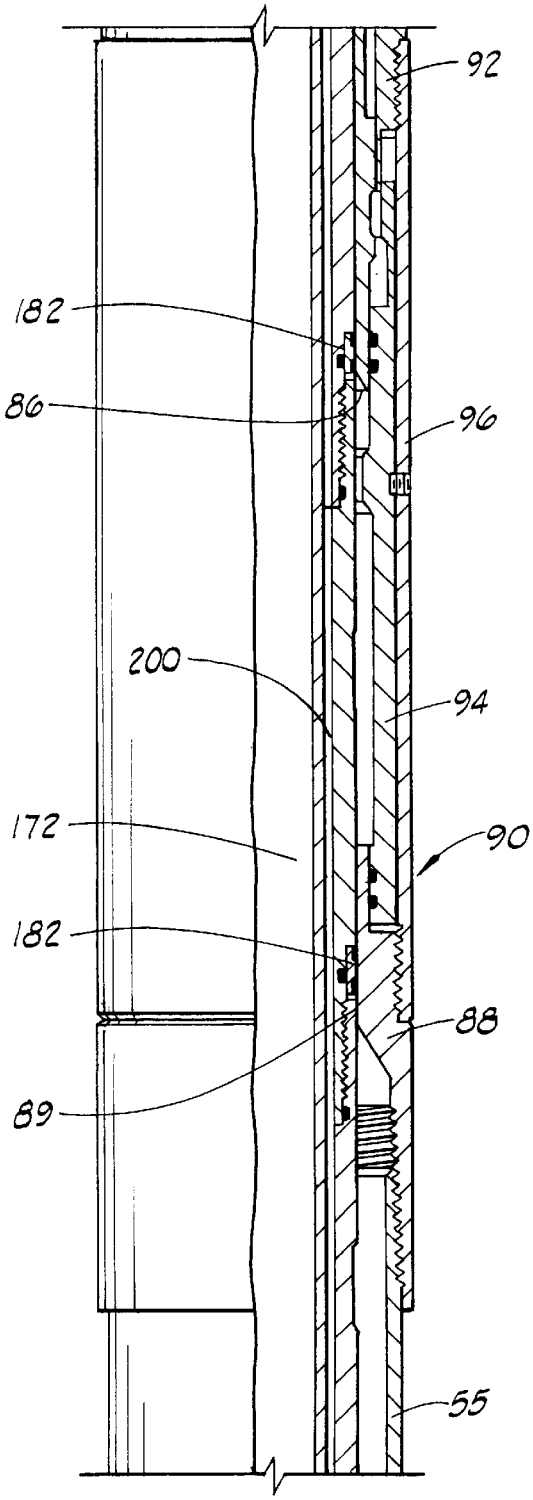
Figure 2E:
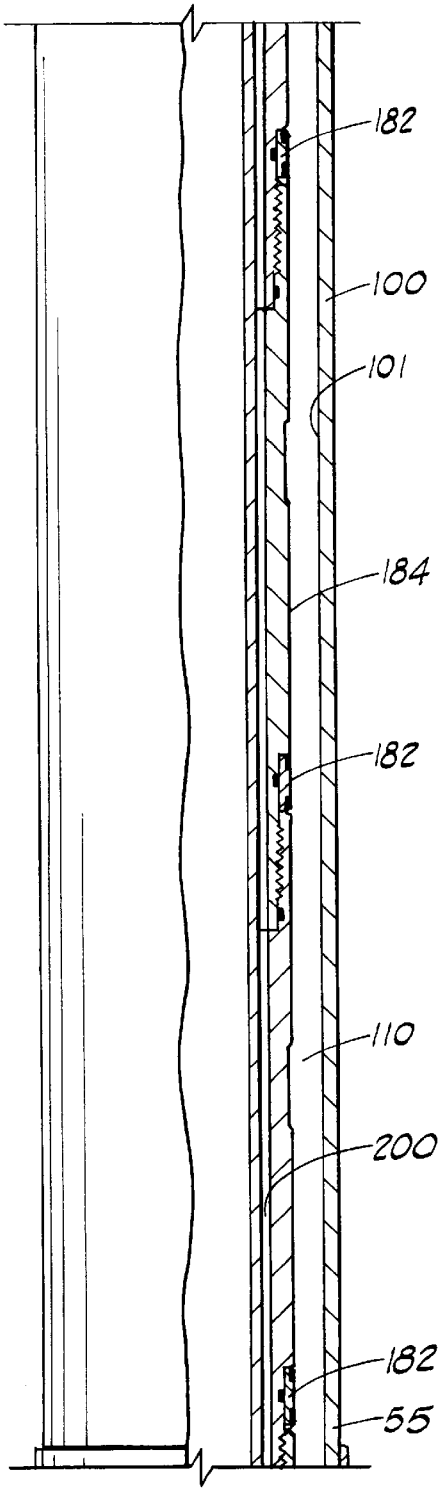
Figure 2F:
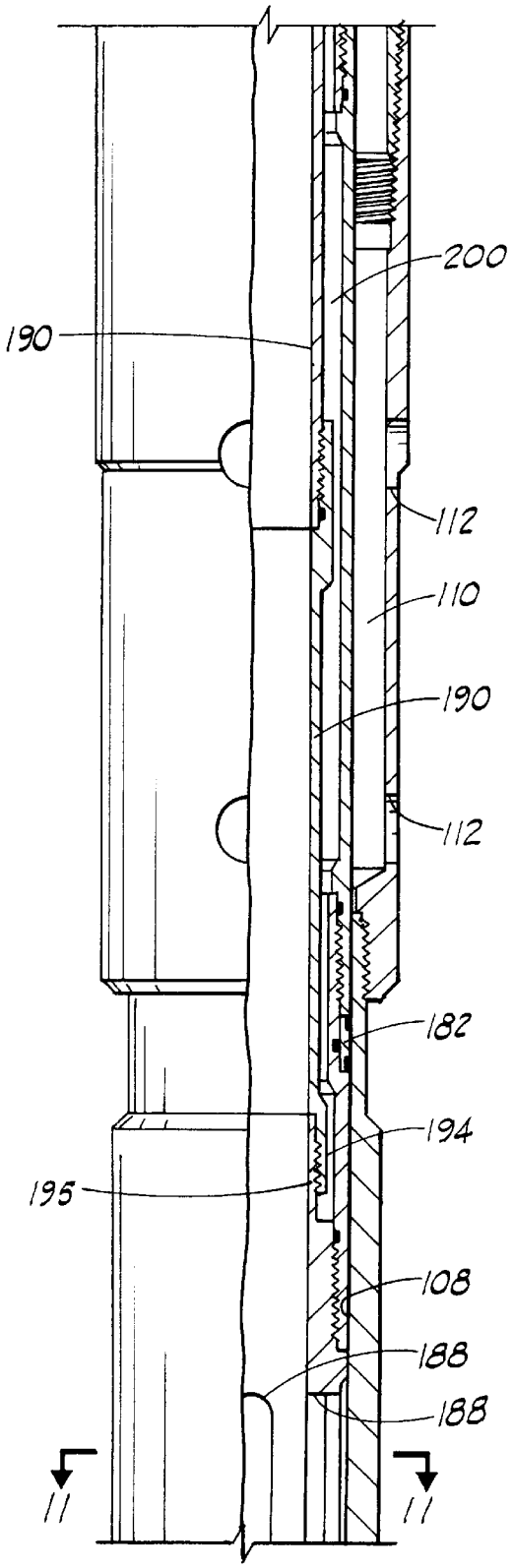
Figure 2G:
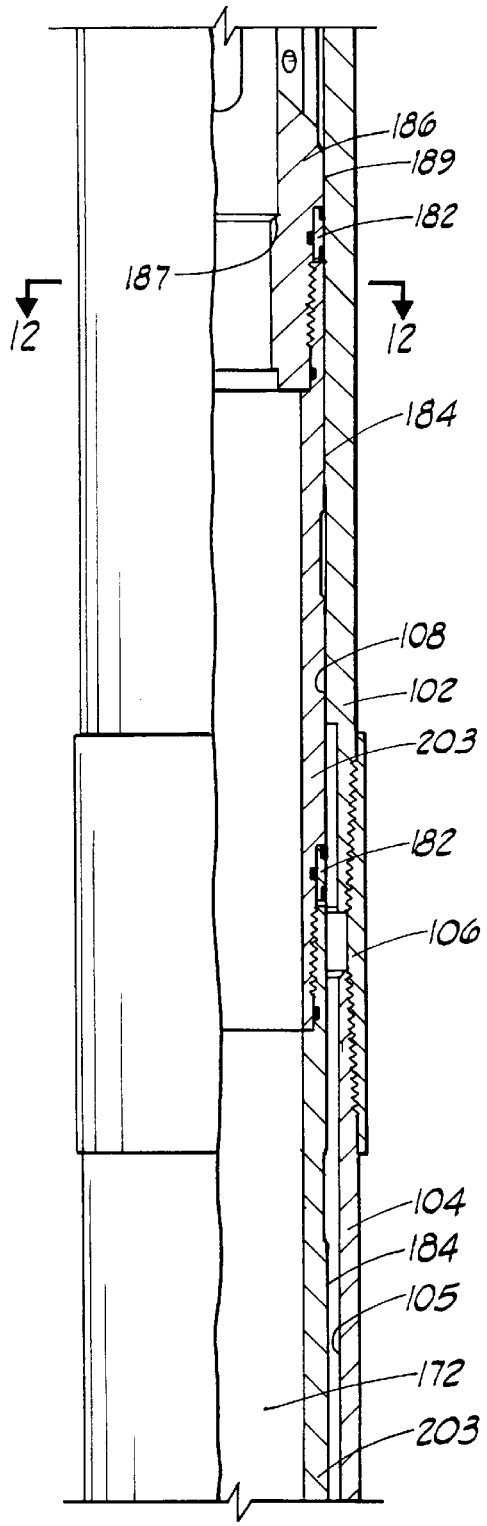
Figure 2J:
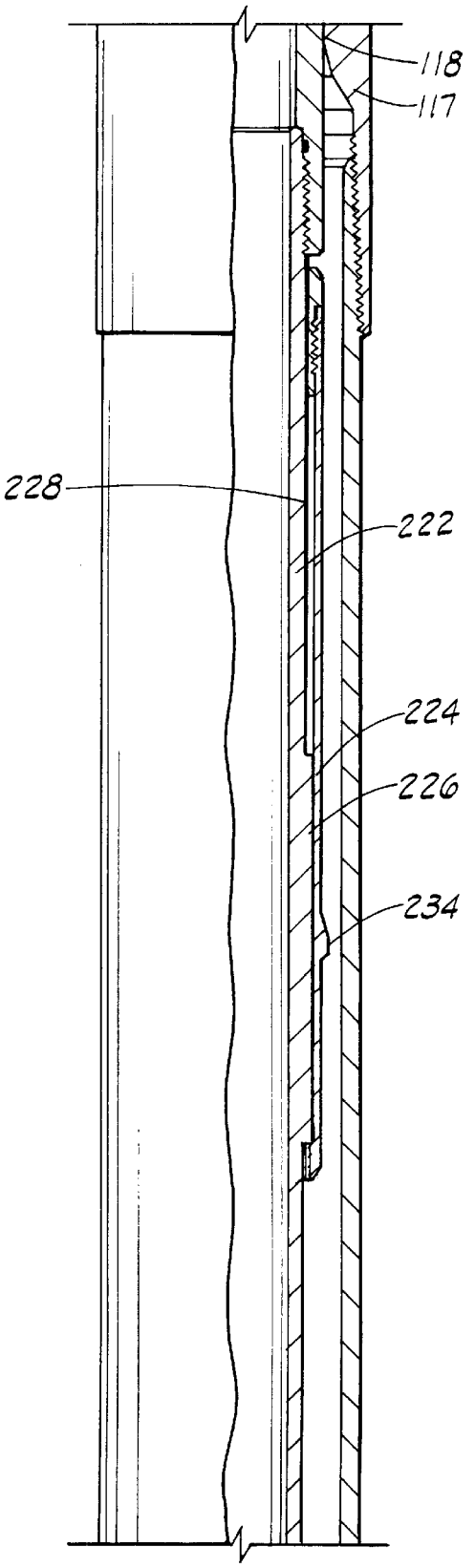
Figure 2K:
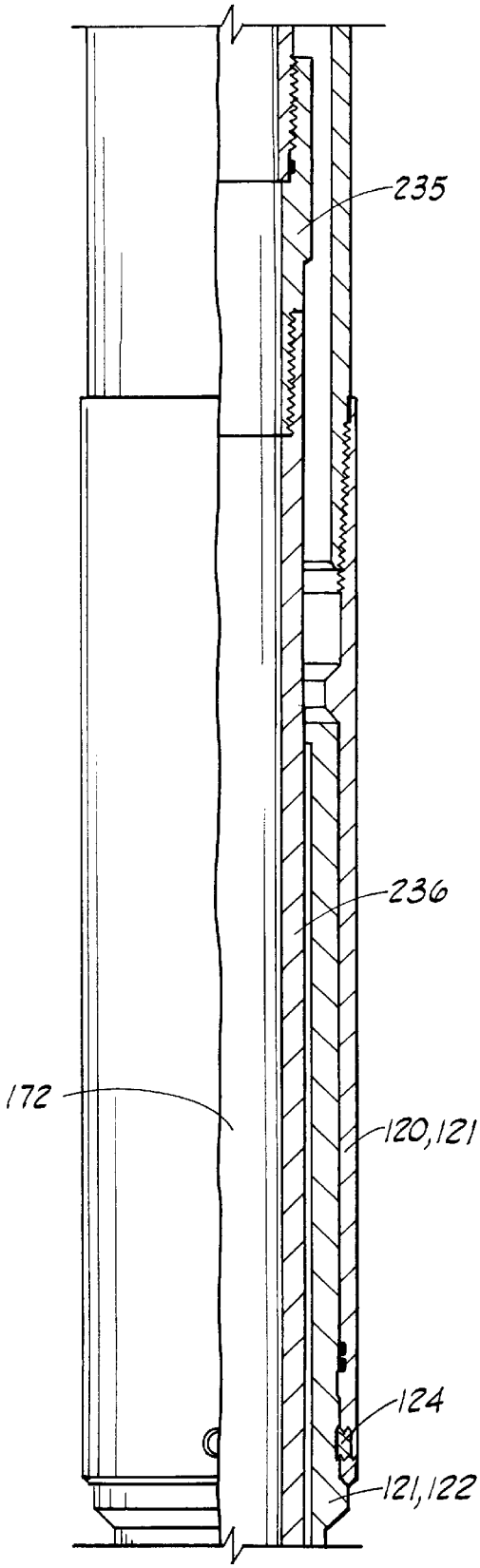
Figure 2L:
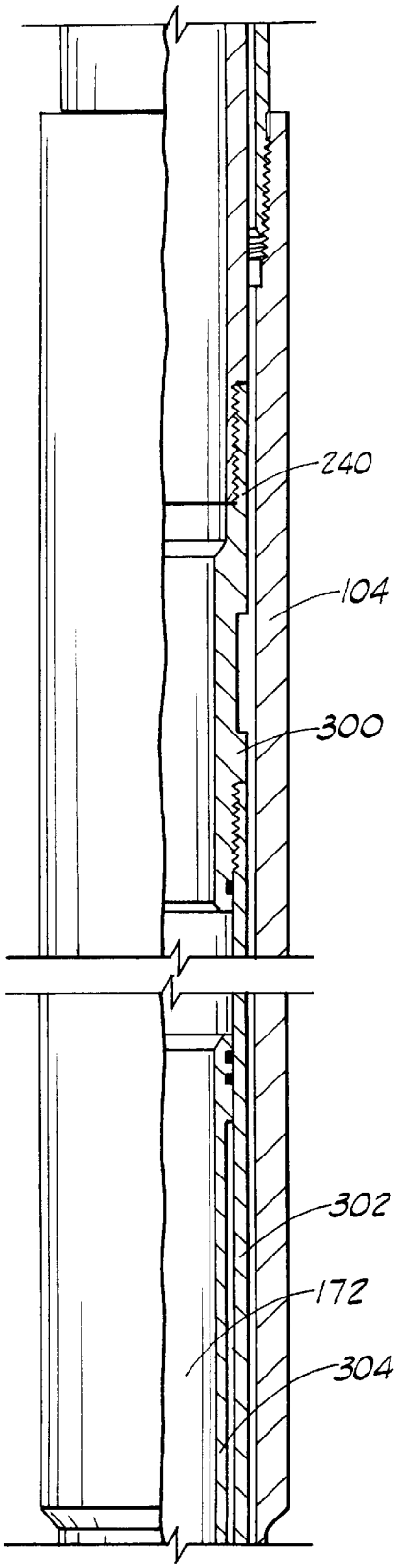
Figure 2M:
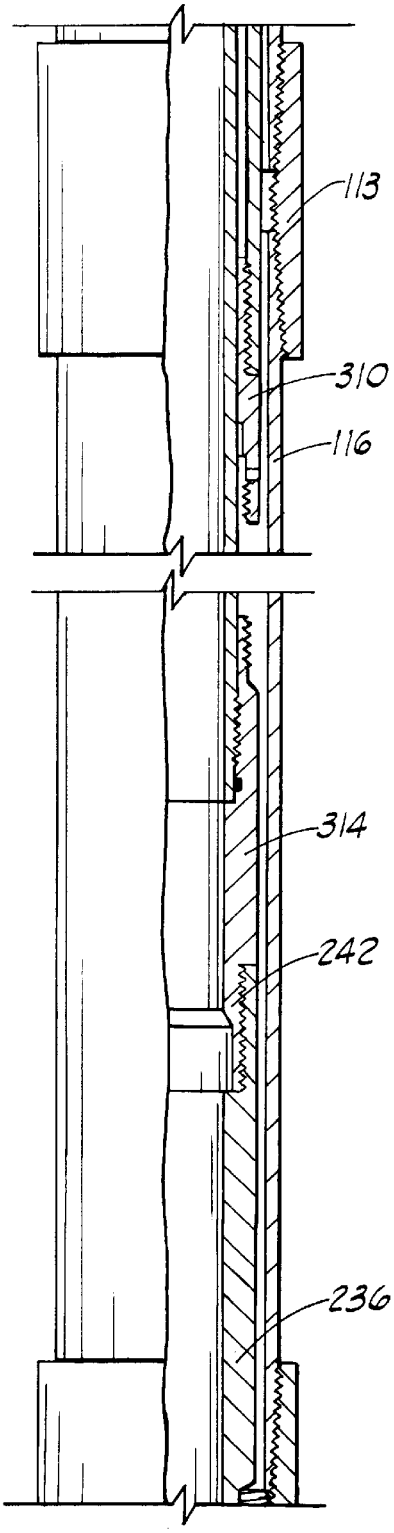
Figure 2N:
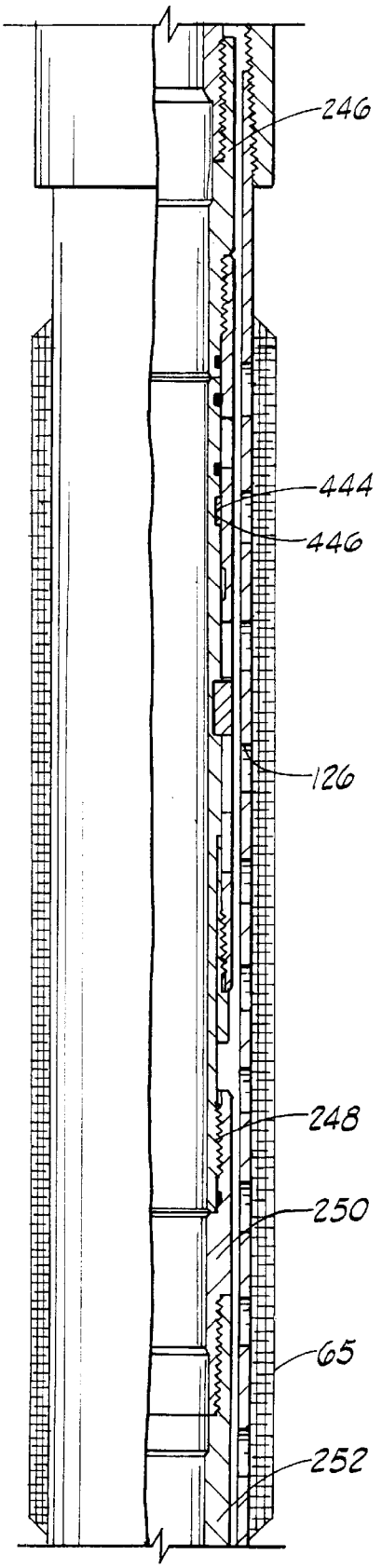
Figure 2O:
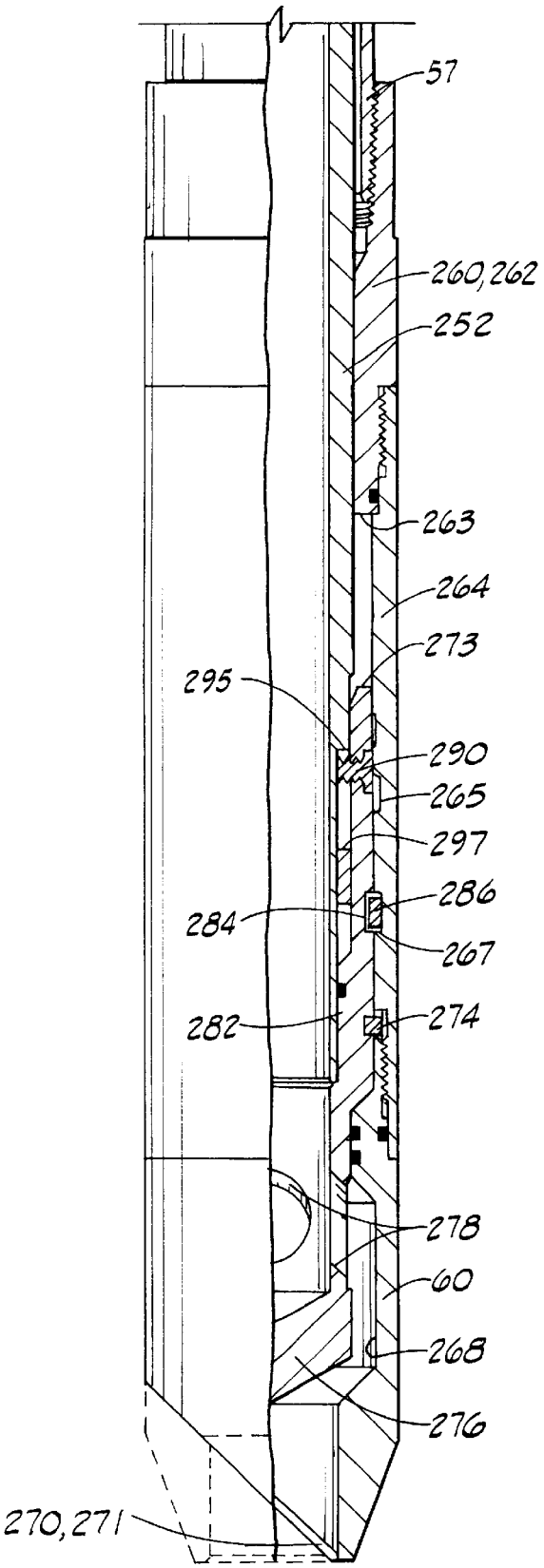
Figure 7:
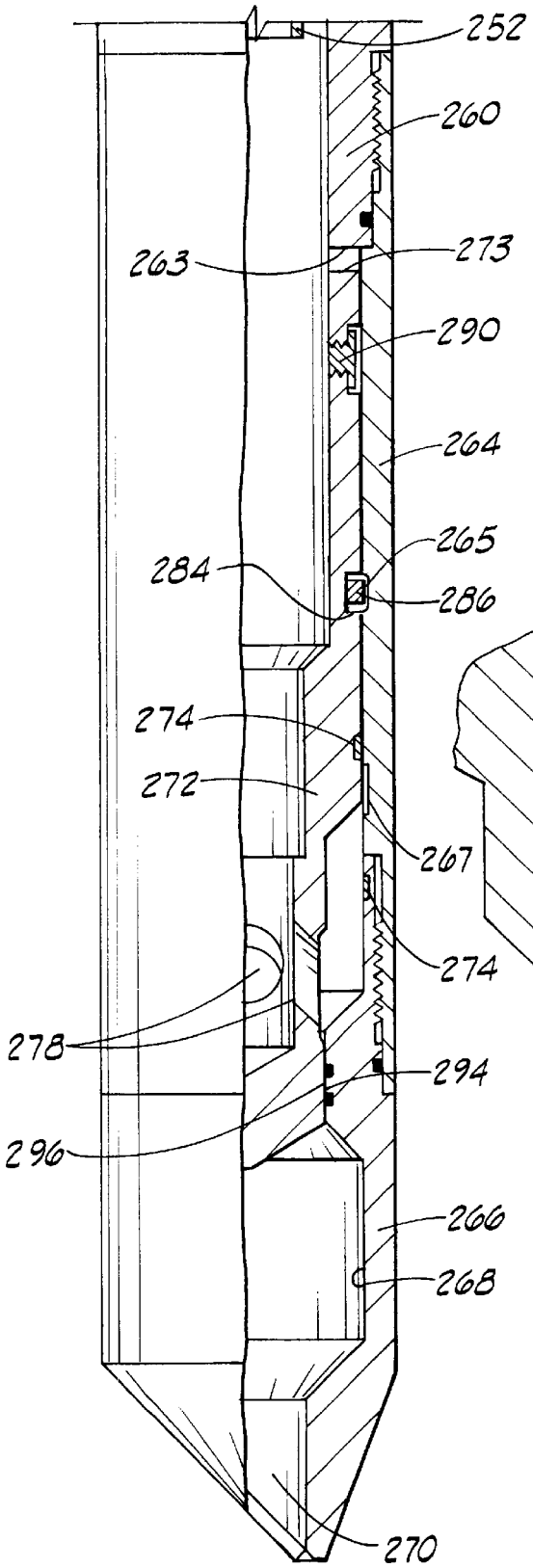
FIG. 7 shows the wash shoe of the present invention in its closed position.

The details of the wash shoe are best seen in FIGS. 2O and 7. Wash shoe 60 includes an outer shoe housing 260 comprising a shoe adapter 262 which is connected to the liner assembly 55, and is preferably connected to screen joint 126. Shoe adapter 262 has a lower end 263. Outer shoe housing 260 further comprises an outer shoe sleeve 264 threadedly connected to shoe adapter 262 and extending downward therefrom. Outer shoe sleeve 264 has an upper groove 265 and a lower groove 267 defined on an inner diameter 269 thereof, and is connected to a lower shoe portion 266. A flow bore 268 is defined in outer housing 260 which has an exit opening 270 at a lower end 271 thereof.

Wash shoe 60 further includes an inner sleeve 272 disposed in outer housing 260. Inner sleeve 272, which may be referred to a retractable sealing sleeve, has an upper end 273 and is releasably attached to outer housing 260 with shear pins 274. Inner sleeve 272 has a lower end 276 with a plurality of flow ports, or shoe ports 278 defined therethrough and has an inner bore 282 for sealingly receiving wash pipe stinger 252. Thus, when service tool 45 is in first position 191, shown in FIGS. 2A through 2O, central flow passage 172 is communicated with the wellbore through flow ports 278 in inner sleeve 272 and exit opening 270 defined at lower end 271 of wash shoe 60.

Figure 10:
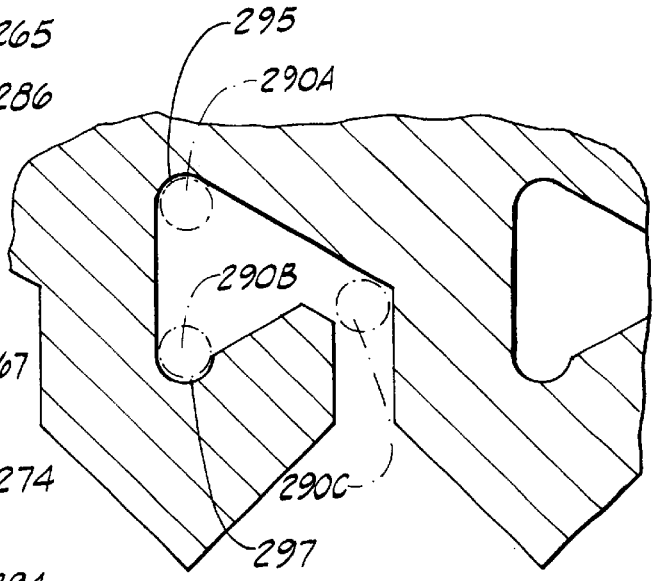
FIG. 10 is a plan view of a J-slot arrangement on the wash pipe stinger.

Inner sleeve 272 has a groove 284 disposed therein for carrying a snap ring 286. As shown in FIG. 2O, snap ring 286 is initially positioned in groove 284 and lower groove 267 defined on inner diameter 269 of outer shoe sleeve 264. Wash pipe stinger 252 is releasably attached to inner sleeve 272 with a shearable lug 290. The lug extends into a J-slot 292 defined on the outer surface of the wash pipe stinger. The J-slot arrangement is shown in plan view in FIG. 10. The wash shoe is shown in FIG. 2O in an open position 291 wherein the central flow passage is communicated with the wellbore through the wash shoe. Wash shoe 60 is a closable wash shoe which may be moved from an open position 291, shown in FIG. 2O, to a closed position 293, shown in FIG. 7, wherein flow therethrough is prevented. To move the wash shoe from the open to the closed position, an upward pull is applied on service tool 45 which will pull wash pipe stinger 252 upward.

In open position 291, the shear lug 290 is located by the numeral 290A in the plan view at the top 295 of the J-slot. When the wash pipe stinger is pulled upwardly, it will engage the lower end 297 of the J-slot as depicted by the numeral 290B. Continued upward pull will cause shear pin 274 to shear since the shear strength of lug 290 is higher than that of shear pin 274. Continued upward pull will cause a lower outer diameter 294 defined on inner sleeve 272 below ports 278 to sealingly engage a shoe housing bore 296 defined in the outer shoe housing. As will be described in more detail hereinbelow, continued upward pull will cause shearable lug 290 to shear thus releasing the wash pipe stinger from the inner sleeve of the wash shoe.

The J-slot arrangement allows service tool 45 to be removed without changing the shoe from the open to the closed position. Removal is accomplished simply by rotating the service tool clockwise to move the lug to position 290C, and then pulling the service tool upward. To do so, however, threaded telescoping assembly 238 must be engaged as is shown in FIGS. 9A–9B.

Telescoping assembly 238 includes an upper head portion 300 having a telescope housing 302 threadedly connected thereto and extending downward therefrom. A travel joint 304 is received in telescope housing 302. Travel joint 304 includes an upper end 306 which has a first outer diameter 308 defined thereon, and has a second outer diameter 309 defined below upper end 306. A downward facing shoulder 311 is defined between first and second diameters 308 and 309, respectively. Diameter 308 is slidably and sealingly disposed in housing 302. Thus, travel joint 304 can move longitudinally with respect to telescope housing 302. A telescope adapter joint 310 having an upper end 313 is threadedly connected to the lower end of housing 302 and has an inner diameter 312 which closely receives diameter 309 of travel joint 304. Second outer diameter 309 is less than diameter 308, so that adapter joint 310 retains travel joint 304 in telescope housing 302. Travel joint 304 is threadedly connected at its lower end to a mounting joint 314. Mounting joint 314 has a male thread 316 defined on its outer surface at an upper end thereof. A female thread 318 is defined on the lower end of telescope adapter joint 310. Female thread 318 has a larger inner diameter than outer diameter 309 of travel joint 304. Female thread 318 will mate with male thread 314 so that telescope housing 302 and the telescoping adapter joint 310 connected thereto will slide downward along travel joint 304 until female thread 318 engages male thread 316. Clockwise rotation will cause threads 316 and 318 to engage, and continued clockwise rotation after full engagement will allow lug 290 to move to position 290C so that upward pull will allow the wash pipe stinger to be removed without closing the wash shoe. Threads 316 and 318 are shown fully engaged in FIG. 9B. When the threads are disengaged upward pull will cause housing 302 to move upward relative to travel joint 304 until upper end 313 of adapter 310 engages shoulder 311, so that any further upward pull will cause travel joint 304, mounting joint 314 and the portion of the service tool connected therebelow to move upwardly.

The operation of the invention is as follows. As shown in FIGS. 2A–2O, multi-position service tool 45 is in first position 191 relative to the production assembly. The universal washdown system is lowered into the well in first or running position 191. The system is lowered on work string 35 which is connected to the work string adapter 144 and thus to multi-position service tool 45. Fluid may be circulated down through the work string as the multi-position tool and production assembly are lowered into the well, through central flow passage 172 and out lower end 271 of the wash shoe so that it travels upwardly in the annulus 25 defined between production assembly 40 and side 30 of wellbore 5. Fluid can also be circulated downward through annulus 25 so that it returns to the surface through the central flow passage 172 and the work string thereabove to the surface. Fluid is circulated to remove any debris that could otherwise cause a gravel pack operation to be aborted. Apparatus 1 is lowered into the well until production screen 65 is adjacent production zone 20. Fluid is continually circulated until the wellbore is sufficiently clean to begin gravel packing.

To set the packer, a multi-piece drop dart 330 is displaced down the work string. A sleeve portion, or setting sleeve 332 of multi-piece drop dart 330 will engage setting or opening sleeve 158. Increased fluid pressure will cause the sleeve 158 to move downward, thus shearing cove vent 160 and establishing fluid communication between central flow passage and chamber 154 through cove vent 60 which may also be referred to as a setting port, so that hydraulic pressure is applied to piston 152. Continued fluid pressure will cause piston 152 to force setting arm 156 downward so that it sets slip carrier assembly 76 and packer sealing elements 75 against the casing. The setting force is directed down the outer packer mandrel 70, and is redirected upward, forcing the slip expanders 80 and 80A under the slip assembly so that the slips are brought into biting engagement with the casing 10. Once the slip assembly is set, continued application of fluid power to the setting mechanisms of the packer moves the seal expander 82 against the sealing elements 75. Sealing elements 75 are compressed longitudinally between the seal expander 82 and seal retainer 82A causing the sealing elements to expand radially into the casing thus sealing off the wellbore and suspending the production assembly in place. The packer setting tool and packer arrangement along with the operation thereof are more fully explained in U.S. Pat. No. 5,103,902 to Ross et al., U.S. Pat. No. 5,343,949 to Ross et al., and U.S. Pat. No. 4,832,129 to Sproul et al., the details of all of which are incorporated herein by reference.

Figure 3:
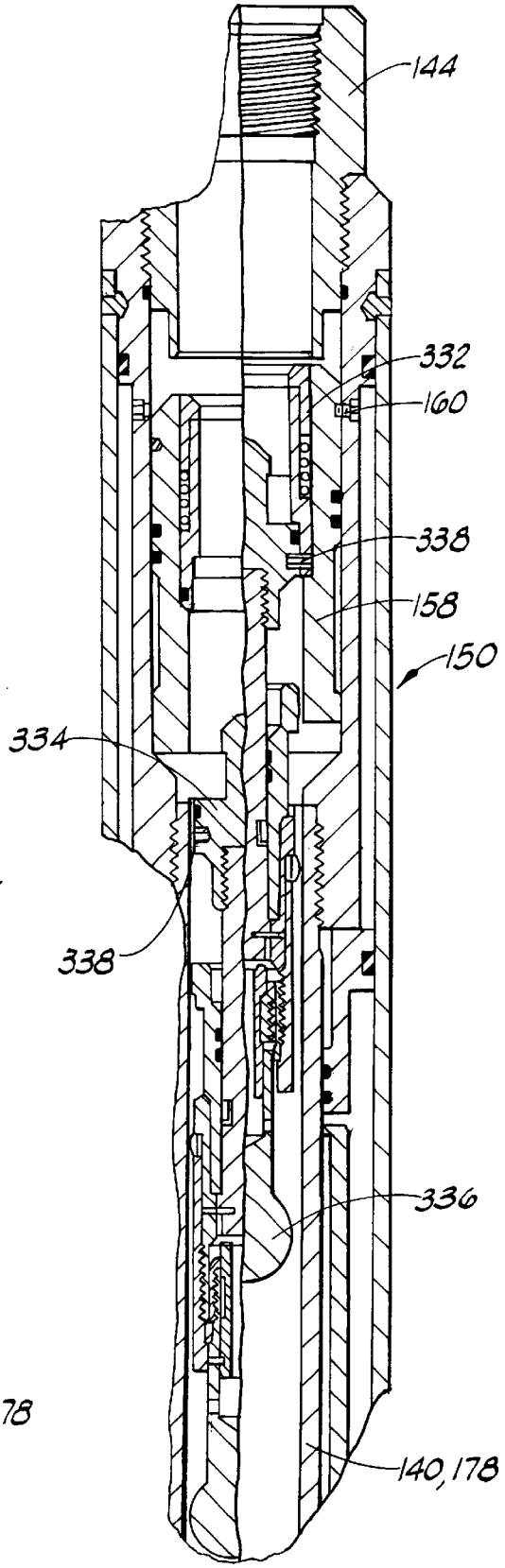
FIG. 3 is a split section view of the upper end of the service tool wherein the right half of the section view shows the three-piece drop dart of the present invention engaged with the opening sleeve and the left half of the section view shows the sealing dart portion of the drop dart separated from the outer setting sleeve.
Figure 21H:
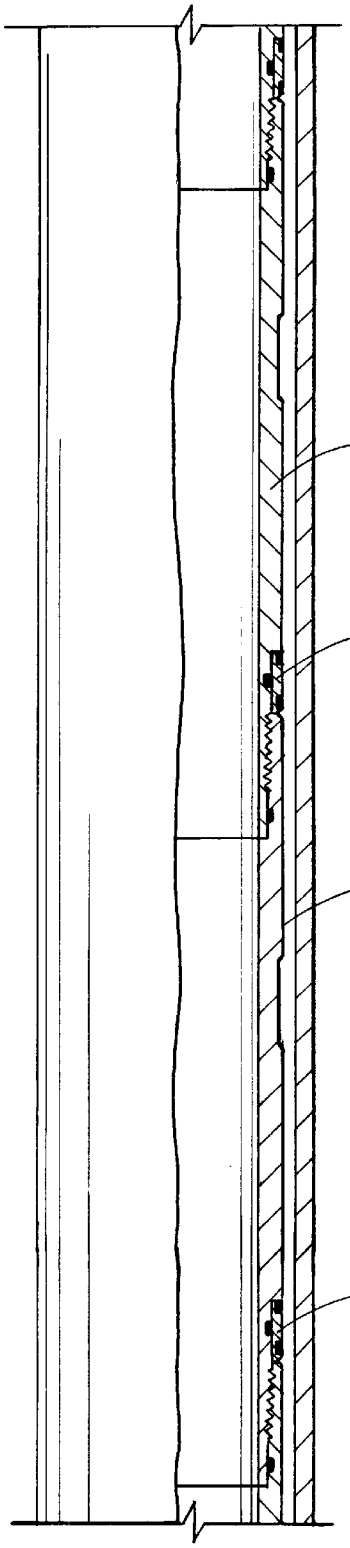
Figure 21I:
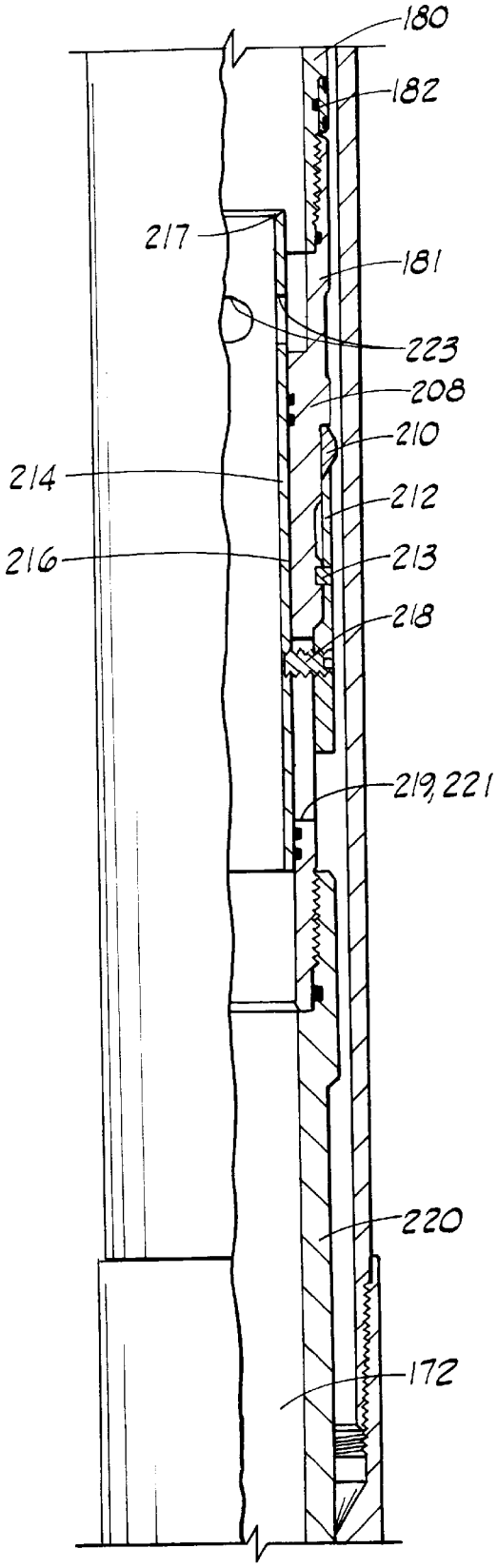

In addition to outer setting sleeve 332, the multipiece drop dart 330 includes a crossover sealing portion, or sealing dart 334, and a ball portion or closing ball 336. Setting sleeve 332 is connected to sealing dart 334 with shear pins 338. Lower end 161 of opening sleeve 158 will engage upward facing shoulder 143 and prevent setting sleeve 332 and opening sleeve 158 from passing downward through central flow passage 172. Thus, fluid pressure, in addition to setting the packer will cause pins 338 to break, allowing sealing dart 334 and closing ball 336 of the multi-piece drop dart to be displaced downward through central flow passage 172. FIG. 3 is a split section, with the right-hand side showing the multi-piece drop dart engaging the opening sleeve, and the left-hand side showing the apparatus after fluid pressure has caused cove vent 160 to shear and pins 338 to break, releasing sealing dart 334 from setting sleeve 332.

Figure 4A:
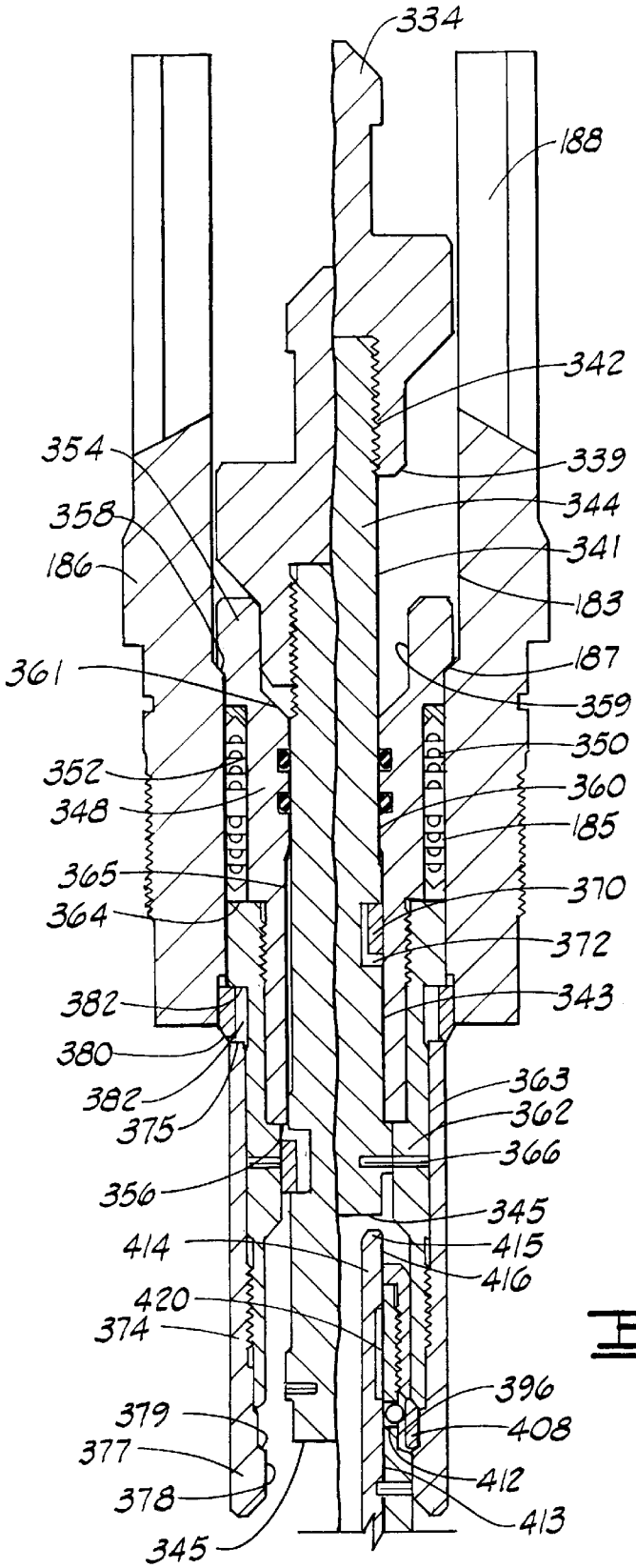
FIGS. 4A and 4B are split sections, with the right-hand side showing the multi-piece drop dart as it first engages the crossover seat, and the left-hand side showing the drop dart after the closing ball has been disengaged.
Figure 4B:
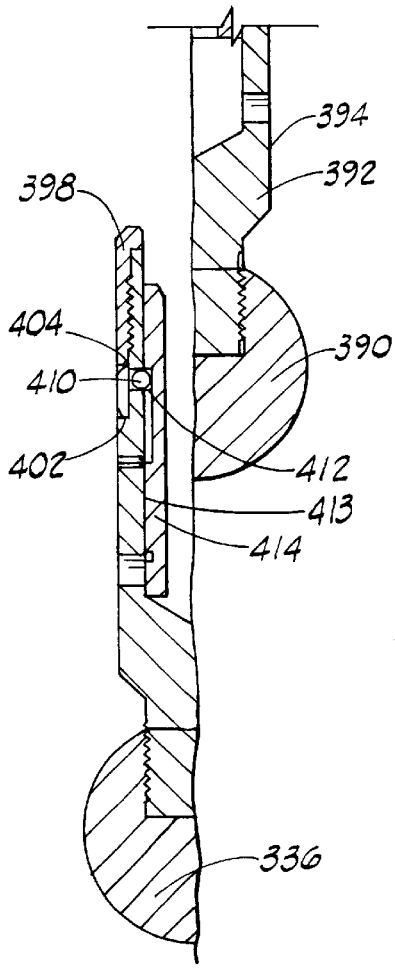

Sealing dart 334 includes a head 340 having a threaded recess 342 defined in the lower end 339 thereof. A longitudinal stem 344, having a first outer diameter 341, a second outer diameter 343, and a lower end 345 is threadedly connected to and extends downward from threaded recess 342. Sealing dart 334 further includes a sealing sleeve 348 having a plurality of seals 350 disposed about a recessed outer diameter 352 thereof. Sealing sleeve 348 has an upper end 354 and a lower end 356. A tapered downward facing shoulder 358 is defined at the upper end of the sealing sleeve. Tapered shoulder 358 will engage seat 187 defined on crossover piece 186. Sealing sleeve 348 has a first inner bore 359 and a second bore diameter 360 with an upward facing seat 361 defined therebetween. Seals 350 sealingly engage second inner bore 185 of crossover piece 186 when shoulder 358 engages seat 187. A longitudinal seal retainer 362 having an outer surface 363 and an upper end 364 is threadably connected to lower end 356 of sealing sleeve 348 and holds seals 350 in recessed diameter 352. Shear pins 366 connect longitudinal stem 344 to threaded seal retainer 362. FIGS. 4A and 4B are split section views with the right side showing the multi-piece drop dart after sealing sleeve 348 has engaged crossover seat 187, and the left side showing the multi-piece drop dart after fluid pressure has been increased to shear pins 366 and detach closing ball 336 as will be more fully described herein.

First outer diameter 341 of longitudinal stem 344 is slidably and sealingly received in second inner bore 360 of sealing sleeve 348. A lock ring 370 is disposed in a circumferential groove 372 defined on second outer diameter 343 of stem 344. Second outer diameter 343 is closely received in a third inner bore 365 of sleeve 348. A tail portion 374 having an upper end 375 is disposed about and extends downward from seal retainer 362, and is threadedly connected thereto at threaded connection 376. Tail portion 374 further includes a lower end 377 having an inner bore 378. A tapered upward facing shoulder 379 is defined on tail portion 374 above inner bore 378. A lock ring 380 is disposed in a groove 382 defined on outer surface 363 of threaded seal retainer 362 above tail portion 374. Upper end 375 of tail portion 374 defines a lower end of groove 382.

Ball portion 336 comprises a sealing ball 390 having an upwardly extending ball stem 392 threadedly connected thereto and extending upwardly therefrom. Ball stem 392 has a first outer diameter 394 and a second outer diameter 396 radially stepped inwardly therefrom. Before ball portion 336 is separated from sealing dart 334, first outer diameter 394 is received in inner bore 378 of tail portion 377. A clip retainer 398 is threaded to the upper end 400 of ball stem 392. An upwardly facing shoulder 402 is defined between diameters 394 and 396. A lower end 404 of clip retainer 398 and upwardly facing shoulder 402 define a groove 406, for receiving a snap ring 408. A circular locking clip 410 is received in a slot 412 defined in ball stem 392. Circular locking clip 410 is positioned adjacent snap ring 408. Ball stem 392 has an inner bore 413. A stem retainer 414 has an outer diameter 416 closely received in inner bore 413. Stem retainer 414 is attached to stem 392 with shear pins 418 and is positioned so that outer diameter 416 covers slot 412 to push circular locking clip 410 into engagement with snap ring 408 thereby deflecting snap ring 408 outwardly so that it engages tapered upwardly facing shoulder 379 defined on tail portion 374 of sealing dart 334 and releasably connecting ball portion 336 to sealing dart 334. A clip receiving groove 420 is defined on outer diameter 416 of stem retainer 414 and is positioned above slot 412.

After the packer has been set and the setting sleeve 332 has been separated from the remainder of the multi-piece drop dart, sealing sleeve 348 will engage crossover seat 187. Snap ring 380 will deflect radially outwardly so that the snap ring and a downwardly facing shoulder 349 defined on crossover piece 186 below bore 185 will prevent any upward movement of sealing sleeve 348. The right side of the split section in FIGS. 4A and 4B shows the drop dart after crossover sleeve 348 has engaged seat 187, but prior to separation of the ball portion. The left side shows the ball portion separated, which occurs due to continued application of fluid pressure. Such pressure will cause shear pins 366 to shear, separating stem 344 from seal retainer 362 and allowing the stem 344 to slide downward therein. Lower end 339 of head 340 is received in diameter 359, and will engage shoulder 361 to stop downward movement thereof. Lower end 345 of stem 344 will engage upper end 415 of stem retainer 414. Fluid pressure will then cause shear pin 419 to break so that stem retainer 414 will move downwardly with respect to ball stem 392 until circular locking clip 410 deflects radially inwardly into groove 420. Snap ring 408 will likewise deflect radially inwardly thus releasing engagement between snap ring 408 and shoulder 379. Closing ball 336 is thus separated from sealing dart 334, and can be displaced downward until ball 390 engages the upper end 217 of ball seat 214. Snap rings 370 will expand radially outwardly so that upward movement of head portion 340 is prevented by snap rings 370 and lower end 356 of sealing sleeve 348. Thus, the multi-piece drop dart acts as a setting means for setting the packer and a sealing means sealing the central flow passage and preventing flow downward therethrough below the crossover piece.

Once the sealing dart and the closing ball of the multi-piece drop dart have been received in the crossover seat and ball seat, respectively, the multi-position service tool can be moved from first position 191 to a second position 422 to perform gravel packing operations. To move the tool from first position 191 to second position 422, the work string is pulled upwardly. Pins 84 are sheared so that the service tool is free to be moved upwardly in the production assembly. Once the pins 84 are sheared, continued upward pull will cause locking heads 234 to engage collet indicator 118. As the service tool is pulled upward, radially outwardly stepped shoulder 226 will move upward relative to collet fingers 232 and heads 234. Once radially outwardly stepped shoulder 226 moves upwardly past locking heads 234, collet fingers 232 will deflect radially inwardly. Ultimately, the fingers will deflect inwardly so that continued upward pull will bring locking heads 234 upwardly past collet indicator 118. Weight is then set back down. Radially outwardly stepped shoulder 226 will slide downward relative to collet fingers 232 so that collet heads 234 will not deflect inwardly and are brought into engagement with collet indicator 118, thereby holding multi-position service tool 45 in second position 422.

Figure 6A:
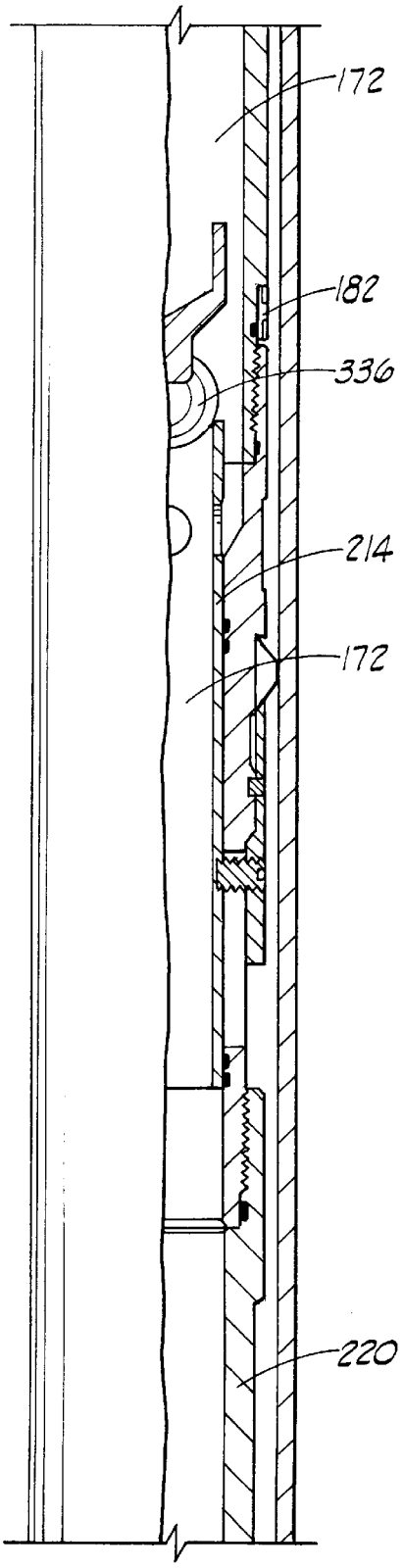
FIGS. 6A and 6B are partial elevation and section views of the invention showing a portion of the service tool including the collet after the service tool has been moved in the production assembly to its second position.
Figure 6B:
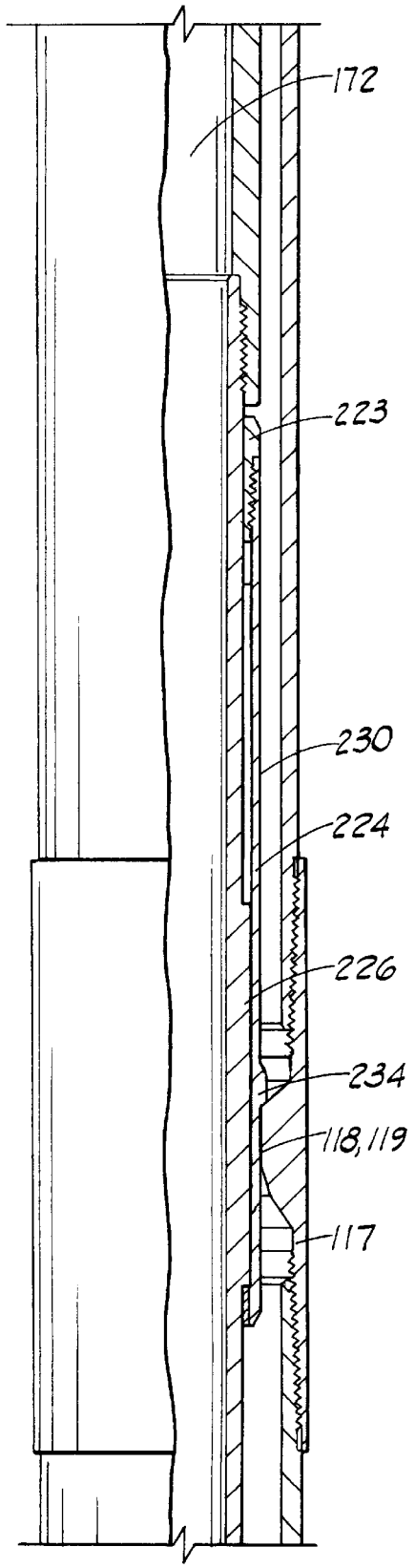

FIGS. 6A and 6B show a portion of the service tool in second position 422 with the collet heads engaging the collet indicator. The details of closing ball 336 are not shown therein completely for purposes of clarity, but are shown in FIGS. 4A–4B. Thus, a tool retaining means for retaining the tool in its second position is included.

As the service tool is pulled from first position 191 to second position 422, the wash shoe 60 will be moved from its open position 291 to its closed position 293. As explained previously, upward pull on the service tool will bring lug 290 into engagement with the upper end of J-slot 292. Continued upward pull will cause pins 274 to shear. Lower outer diameter 294 of inner sleeve 272 is then pulled upwardly into sealing engagement with shoe housing bore 296 thus preventing flow through ports 278. Once the inner sleeve is brought into sealing engagement with the housing bore, the potential for fluid lock, which can prevent further upward pull, exists. Circulation valve 244 has therefore been included in the service tool.

Circulation valve 244 comprises an upper valve sub 430 adapted to be threadedly connected in the service tool. An outer valve housing 432 is threadedly connected to the upper valve sub 430 and extends downward therefrom. Upper valve sub 430 extends downwardly into housing 432 and sealingly engages an inner diameter 434 thereof. A lower valve sub 436 having an upper end 437, a first outer diameter 438 and a second outer diameter 440 is slidably and sealingly received in inner diameter 434 of outer valve housing 432. A downward facing shoulder 439 is defined between diameters 438 and 440. A plurality of flow ports 442 are defined through outer valve housing 432. In a closed position, as shown in FIG. 2, housing 432 is in sealing engagement with first outer diameter 438 of lower valve sub 436 above and below flow ports 442 so that communication therethrough is blocked. A snap ring 444 is received in a groove 446 defined on first outer diameter 438 of lower valve sub 436. Outer valve housing 432 is connected to lower valve sub 436 with shear pins 448 and torque transfer lugs 450. Torque transfer lugs 450 are disposed in a slot 452 defined in outer valve housing 432 which allows housing 432 to move longitudinally with respect to lower valve sub 436 while still allowing torque transmission.

Figure 8A:
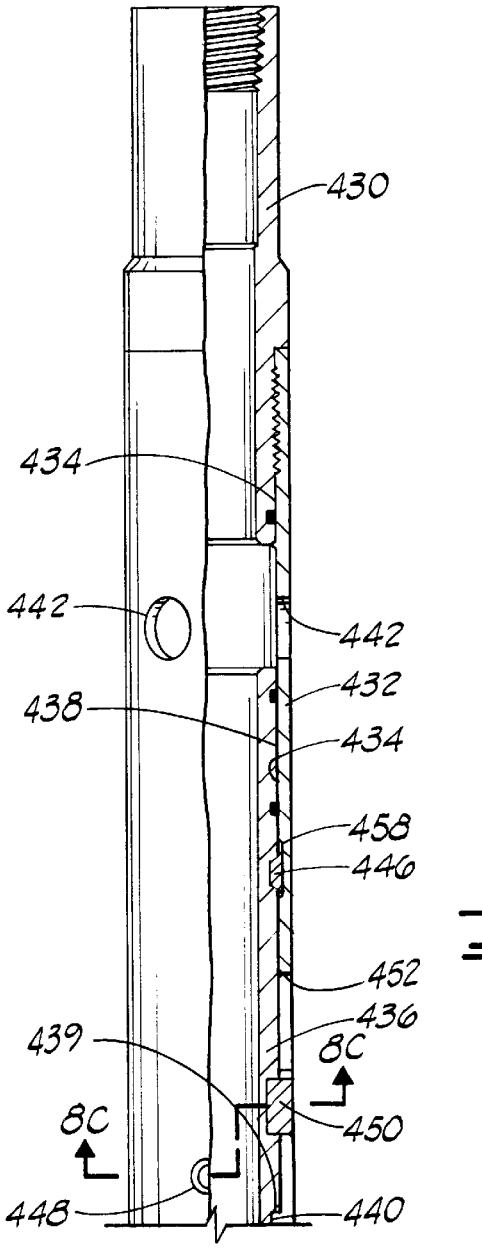
FIGS. 8A and 8B are views partially in section and partially in elevation of the circulation valve of the present invention in its open position.
Figure 8B:
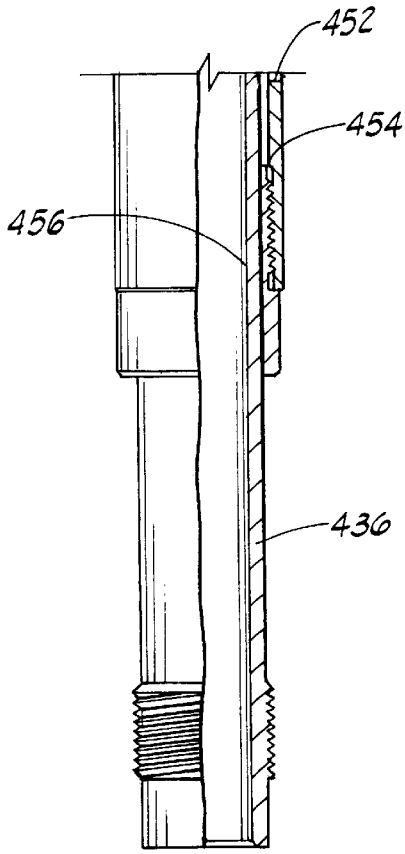
Figure 8C:
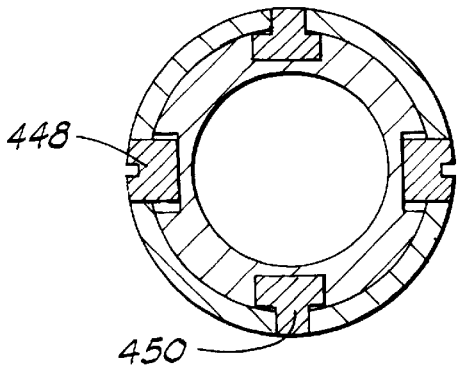
FIG. 8C is a section view from line 8C—8C in FIG. 8A.
Figure 3A:
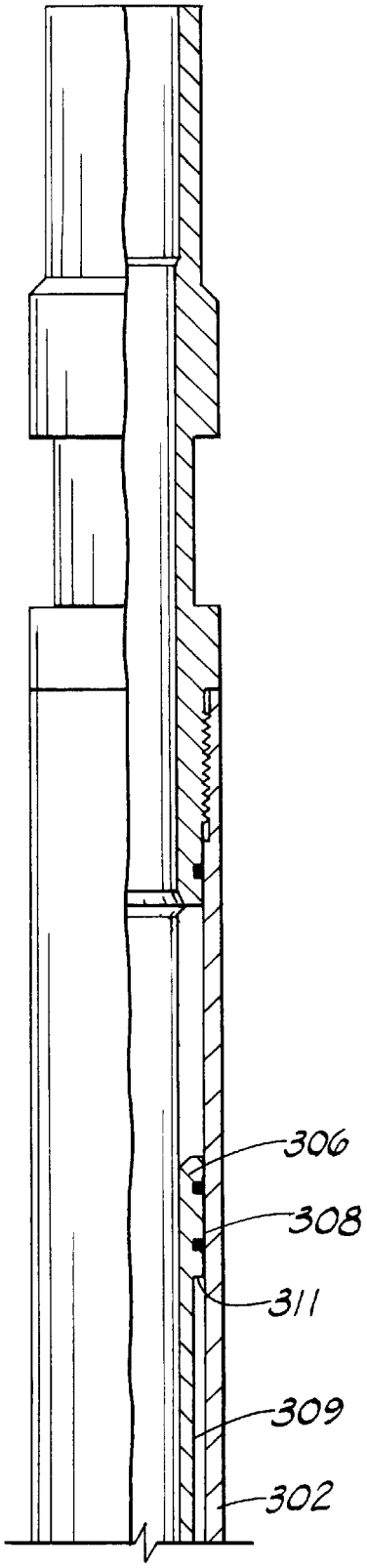
Figure 3B:
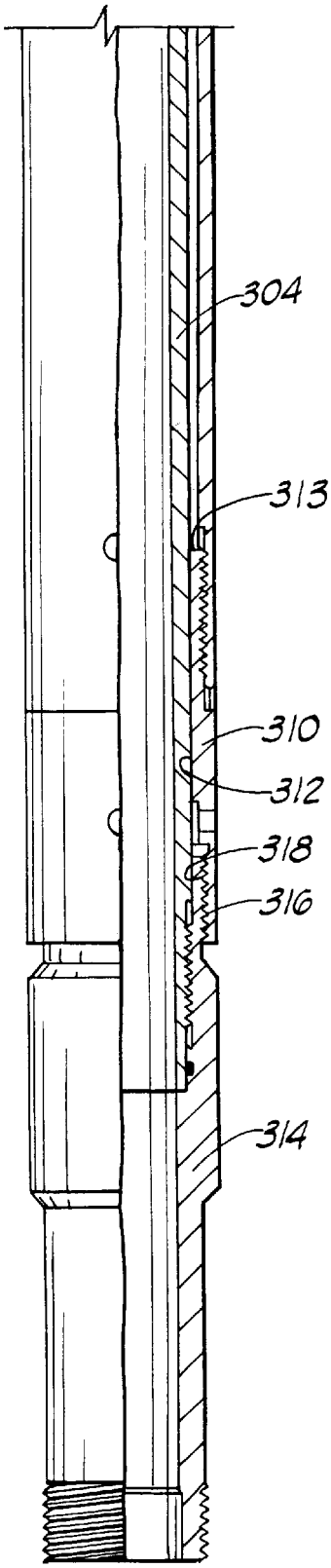

As the service tool is pulled upward, shear pins 448 will shear if fluid lock occurs. Upper valve sub 430 and outer valve housing 432 will then move upwardly with respect to lower valve sub 436. An upward facing shoulder 454 defined on valve housing 432 will engage downward facing shoulder 439 to limit movement of the housing relative to the lower valve sub, so that continued upward pull will cause lower valve sub 436 and the wash pipe stinger 252 attached therebelow to move upward. Lower valve sub 436 may be connected to wash pipe stinger 252 with an adapter 435. After pins 448 have been sheared and valve housing 432 pulled upward, ports 442 will be positioned above the upper end 437 of lower valve sub 436, as shown in FIGS. 8A and 8B so that ports 442 can communicate the wellbore with an inner bore 456 of the circulation valve which makes up a part of central flow passage 172, thus breaking any fluid lock that might occur. Inner bore 456 may also be referred to as a longitudinal valve passageway. The outer housing is pulled upwardly a sufficient distance so that snap ring 444 will deflect outwardly into a groove 458 defined on the inner diameter 434 of the valve housing, thereby positively locking the housing in place in the circulation position, to prevent port 442 from falling downward below upper end 437 of the lower valve sub 436.

Referring now back to FIGS. 2O and 7, continued upward pull on service tool 45 will bring upper end 273 of inner sleeve 272 into engagement with lower end 263 of shoe adapter 262. Lug 290 will shear thus releasing wash pipe stinger 252 from inner sleeve 272 of wash shoe 60. Snap ring 286 will deflect outwardly into groove 265 defined on an inner bore 267 of outer sleeve 264 to prevent the inner sleeve from sliding downward in outer housing 260, thus retaining inner sleeve 272 in closed position 293 wherein lower outer diameter 294 of inner sleeve 272 sealingly engages shoe housing bore 296 to prevent flow through ports 278 into wellbore 5. Thus, the shoe includes a shoe retaining means for retaining the shoe in the closed position. If no fluid lock occurs causing pins 448 in circulation valve 244 to shear; pins 448 will break prior to the time lug 290 shears, allowing the circulation valve to be moved into the circulation position, wherein ports 442 communicate with central flow passage 172. Thus, the circulation valve will be moved into the circulation position when service tool 45 is pulled upwardly to second position 422.

Lower end 254 of wash pipe stinger 252 will preferably be adjacent production screen 65 when service tool 45 is in second position 422, so that liquid used to carry the gravel pack material can circulate into the central flow passage 172 through production screen 65 and lower end 254 of wash pipe stinger 252. Liquid can also circulate into central flow passage 172 through ports 442 defined in circulation valve 244. Thus, the invention includes circulation means for circulating liquid into the central flow passage 172 from well annulus 25. Once the service tool has been pulled into second position 422, gravel packing can begin.

Figure 5A:
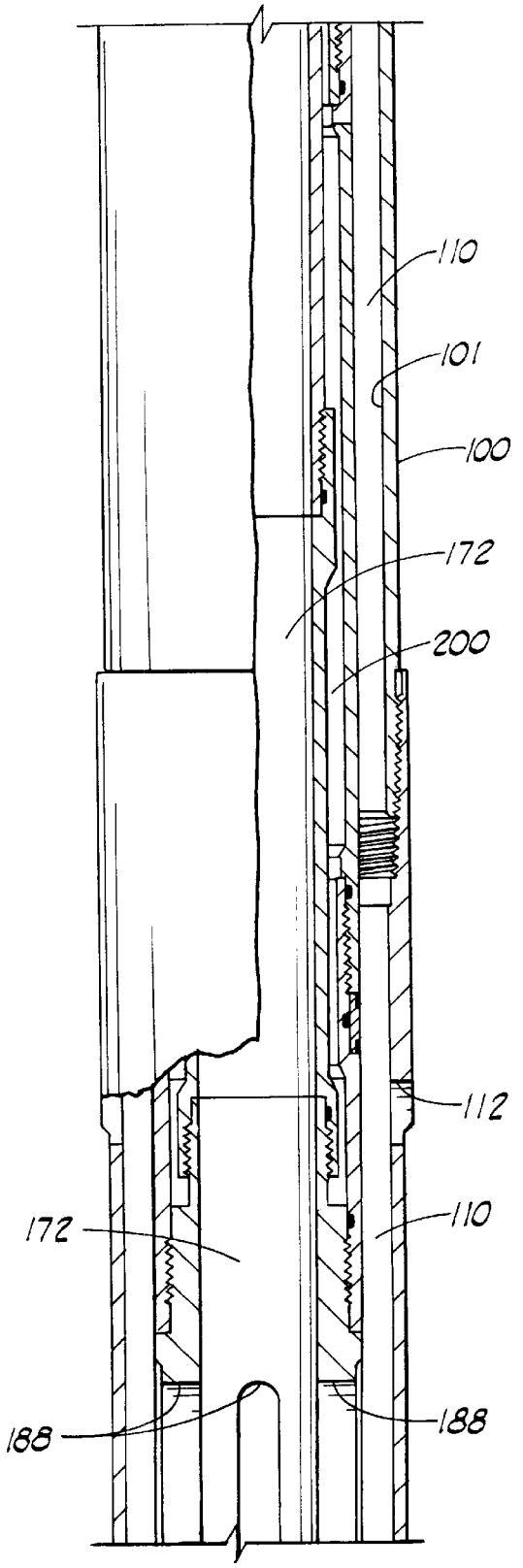
FIGS. 5A and 5B are partial elevation and section views showing the portion of the service tool including the crossover after the service tool has been moved into the second position.
Figure 5B:
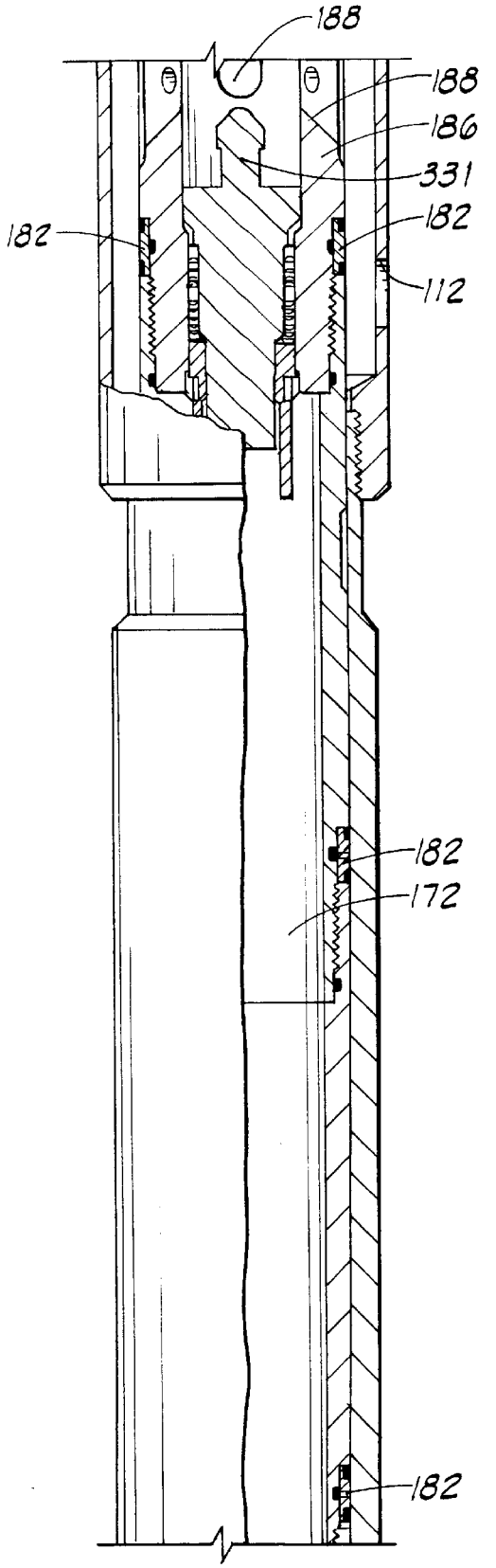

The gravel pack operation comprises lowering the assembly into the wellbore and circulating a fluid down through the work string, and up the annulus between the wellbore and the assembly, to remove any debris from the wellbore. Fluid can also be circulated down the annulus and up the central flow passage. The assembly is lowered into the wellbore until the production screen is adjacent the production zone. Fluid is circulated until the wellbore is sufficiently clean so that gravel packing can begin. When the tool is in first or running position 191, crossover ports 188 are longitudinally offset from flow passage 110 and flow ports 112, and are circumscribed by and sealingly received in seal bore 108 so that no flow therethrough is allowed. Once the wellbore is clean, the method comprises suspending the assembly in the wellbore, and sealing the central flow passage to prevent downward flow below the crossover. The service tool is then pulled upwardly into second position 422. When multi-position tool 45 is in second position 422, crossover ports 188 are adjacent annular flow passage 110. Thus, crossover ports 188 are in communication or aligned with annular flow passage 110 and flow ports 112. FIGS. 5A and 5B show the crossover after the tool has been moved to second position 422, so that crossover ports 188 and flow ports 112 are in communication. The details of the sealing dart are not shown therein for purposes of clarity, but are shown clearly in FIGS. 4A and 4B.

The method further comprises displacing a gravel pack fluid through the work string into central flow passage 172 after the service tool is moved into second position 422. Gravel pack fluid displaced through central flow passage 172 is prevented from flowing downward past crossover piece 186 by sealing dart 334. Thus, the gravel pack fluid will pass through crossover ports 188 and flow ports 112 into annulus 25 defined between liner assembly 55 and the side 30 of well bore 5. The liquid used in the gravel pack may go into the formation, along with other liquid in the wellbore. A portion of the liquid can pass through the production screen and into central flow passage 172 through the circulation valve or the end of wash pipe stinger 252. The liquid can pass upward through central flow passage 172 until it reaches crossover piece 186. The liquid will then be communicated with annular return passageway 200 through longitudinal return ports 204 defined in crossover piece 186. When the tool is in its second position as schematically shown in FIGS. 1A and 1B, return port 202 is positioned above packer bore 74 so that liquid will circulate therethrough into the well annulus above the packer and to the surface, so that second position 422 is a circulation position. If desired, return ports 202 can be located so that they are positioned and sealed in packer bore 74 so that no flow is permitted therethrough. In such a case, the second position would be referred to as a squeeze position since continued gravel packing will further consolidate the gravel pack and will to a certain extent fracture the formation.

The service tool could then be pulled upwardly and suspended from the surface to a third position which would be the circulation position. Once gravel packing is completed, it is desirable to clean out any gravel still in the central flow passage above the crossover piece. To remove any such gravel, service tool 45 is simply pulled upward until the crossover ports 188 are above the packer. This position may be referred to as the reverse position. Prior to reaching the reverse position, snap ring 210 will engage seal bore 108. Snap ring 210 will be forced downward relative to ball catcher sub 208 and will cause shear pin 213 to shear thus releasing shear carrier 212. Because the shear carrier is connected to the ball seat 214, ball seat 214 and shear carrier 212 will slide downwardly relative to ball catcher sub 208. Connecting lug 218 will engage the lower end of slot 219 defined in ball catcher sub 208 to prevent further downward movement. Outer diameter 215 of ball seat 214 sealingly engages inner diameter 216 of the ball catcher sub above lateral ports 219 thus preventing flow therethrough. Fluid can then be circulated in the annulus between the production assembly and the wellbore. The fluid used to circulate the excess gravel out of the central flow passage will enter the crossover port and will displace any remaining gravel upwardly through the work string to the surface. Once any gravel has been removed, the service tool is pulled to the surface, and production tubing is lowered into the well and connected to the production assembly in a manner known in the art to receive production fluid from the production zone.

Although the embodiment described herein utilizes a closable wash shoe, a mule shoe of a type known in the art can be used in conjunction with the invention. In such a case, fluid may be circulated down the tubing string or in the annulus between the string and the wellbore as the invention is lowered into the wellbore. A sump packer may be positioned in the wellbore below the production zone. Once the mule shoe engages and seals in the sump packer, the packer can be set, the multi-piece drop dart can be displaced into the longitudinal central flow passage and the service tool can be moved upwardly into its second position. Gravel packing can then be conducted as hereinbefore described. If desired, a retrievable packer, can be disposed on the work string above the hydraulically set packer described herein. After debris has been circulated out of the hole as previously described, the Champ packer can be set and gravel pack fluid displaced down the central flow passage out the mule shoe until the gravel pack fills the wellbore above the production zone. The Champ packer can then be released and fluid circulated down through the central flow passage until the mule shoe engages the sump packer. Again, the multi-position service tool can then be pulled into its second position and further gravel packing can continue.

Although the invention has been described with reference to a specific embodiment, and with reference to a specific gravel pack operation, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as fall within the true scope of the invention.

What is claimed is:

1. An apparatus for use in gravel packing a production zone in a wellbore comprising:

a production assembly, said production assembly comprising:

a packer for sealingly engaging said wellbore, said packer having a packer bore defined therethrough;

a liner assembly having a liner bore defined therethrough extending downwardly from said packer, said liner assembly having a production screen connected therein; and a multi-position service tool disposed in said production assembly, said service tool defining a longitudinal central flow passage, said service tool having a plurality of crossover ports defined therethrough intersecting said longitudinal central flow passage for providing communication between said longitudinal central flow passage and an annulus defined between said liner assembly and said wellbore, said service tool being movable from a first position to a second position in said production assembly, wherein said liner bore sealingly engages said service tool when said service tool is in said first position to prevent communication through said crossover ports, and wherein said crossover ports are in communication with a flow port defined through said liner assembly when said service tool is in said second position thereby establishing communication between said longitudinal central flow passage and said annulus, said production assembly further comprising a wash shoe disposed at a lower end of said liner, said wash shoe being changeable from an open position wherein said longitudinal central flow passage is communicated with said wellbore through said wash shoe to a closed position wherein flow through said wash shoe is blocked.

2. The apparatus of claim 1 wherein said wash shoe comprises:

an outer shoe housing having an exit opening defined in a lower end thereof; and an inner sleeve slidably disposed in said outer shoe housing, said inner sleeve having a bore communicated with said longitudinal central flow passage and having a plurality of shoe ports defined therethrough, said shoe ports communicating said bore of said inner sleeve with said exit opening when said service tool is in said first position so that said longitudinal central flow passage is communicated with said wellbore therethrough, said inner sleeve being slidable in said housing to said closed position wherein said inner sleeve seals against said outer housing so that communication through said shoe ports is blocked.

3. The apparatus of claim 2 further comprising shoe retaining means for retaining said inner sleeve in said closed position.

4. The apparatus of claim 2 wherein said service tool includes a wash pipe stinger disposed at a lower end thereof, said wash pipe stinger being releasably connected to said inner sleeve of said wash shoe, and wherein said inner sleeve moves to said closed position from said open position when said service tool is moved from said first to said second position.

5. The apparatus of claim 4 further comprising:

a snap ring disposed in a groove defined on an outer surface of said inner sleeve of said shoe; and a retaining groove defined on said outer shoe housing for receiving said snap ring and retaining said sleeve in said second position.

6. The apparatus of claim 5 further comprising detaching means for detaching said wash pipe stinger from said inner sleeve.

7. The apparatus of claim 6, said detaching means comprising a shear pin connecting said wash pipe stinger to said inner sleeve of said shoe, wherein said shear pin shears when said service tool moves from said first to said second position, thereby detaching said wash pipe stinger from said inner sleeve.

8. An apparatus for use in gravel packing a production zone in a wellbore comprising:

a production assembly, said production assembly comprising:

a packer for sealingly engaging said wellbore, said packer having a packer bore defined therethrough; and a liner assembly having a liner bore defined therethrough extending downwardly from said packer, said liner assembly having a production screen connected therein;

a multi-position service tool disposed in said production assembly, said service tool defining a longitudinal central flow passage, said service tool having a plurality of crossover ports defined therethrough intersecting said longitudinal central flow passage for providing communication between said longitudinal central flow passage and an annulus defined between said liner assembly and said wellbore, said service tool being movable from a first position to a second position in said production assembly, wherein said liner bore sealingly engages said service tool when said service tool is in said first position to prevent communication through said crossover ports, and wherein said crossover ports are in communication with a flow port defined through said liner assembly when said service tool is in said second position thereby establishing communication between said longitudinal central flow passage and said annulus;

an opening sleeve disposed in said service tool, said service tool having a setting port defined therethrough, said opening sleeve being positioned to prevent communication between said longitudinal central flow passage and an annular setting piston through said setting port, said annular setting piston being disposed about said service tool;

a ball catcher disposed in said service tool above said production screen, said service tool having a crossover seat defined therein positioned below said crossover ports and above said ball catcher; and a multi-piece drop dart for engaging said opening sleeve and said crossover seat to seal said longitudinal central flow passage below said crossover ports.

9. The apparatus of claim 8, wherein said multi-piece drop dart comprises:

a setting sleeve for engaging said opening sleeve and moving said opening sleeve downward in said longitudinal central flow passage so that communication between said central flow passage and said annular setting piston through said setting port is established;

a sealing dart releasably attached to said setting sleeve for engaging said crossover seat; and a closing ball releasably connected to said sealing dart for engaging said ball catcher.

10. A washdown apparatus for use in a wellbore comprising:

a production assembly disposed in said wellbore, said production assembly having a longitudinal opening defined therethrough;

a wash shoe disposed at a lower end of said production assembly; and a multi-position service tool disposed in said production assembly, said service tool having a central flow passage defined therethrough communicated with said wash shoe, said wash shoe being movable from an open position wherein said central flow passage is communicated with said wellbore through said wash shoe, to a closed position wherein said wash shoe is sealed to prevent flow therethrough.

11. The washdown apparatus of claim 10 further comprising shoe retaining means for retaining said wash shoe in said closed position.

12. The washdown apparatus of claim 10, said wash shoe comprising:

an outer housing connected to said production assembly, said outer housing defining a flow bore; and a retractable sealing sleeve slidably disposed in said outer housing, said sealing sleeve having a plurality of flow ports defined therethrough, wherein said central flow passage communicates with said flow bore through said flow ports when said wash shoe is in said open position and wherein said sealing sleeve sealingly engages said housing when said wash shoe is in said closed position to prevent flow through said flow ports.

13. The apparatus of claim 12 said multi-position service tool being movable upwardly from a first position to a second position in said production assembly, wherein said sealing sleeve moves upward into said closed position from said open position when said multi-position service tool moves from said first position to said second position.

14. The washdown apparatus of claim 10, said multi-position service tool being slidable upwardly from a first position to a second position in said production bore, said wash shoe being operably associated with said multi-position service tool so that said wash shoe moves from said open to said closed position when said service tool moves from said first to said second position.

15. The apparatus of claim 14 wherein:

said multi-position service tool comprises a lower end sealingly disposed in and releasably connected to said wash shoe, said multi-position service tool being retracted from said wash shoe when said multi-position service tool moves from said first to said second position.

16. The apparatus of claim 14, said multi-position service tool further including a crossover piece, said crossover piece having a plurality of crossover ports defined therethrough intersecting said longitudinal central flow passage, wherein said crossover piece sealingly engages a seal bore defined in said production assembly to prevent communication through said crossover ports when said service tool is in said first position.

17. The apparatus of claim 16, said production assembly having a plurality of flow ports defined therethrough above said seal bore, wherein said crossover ports are in communication with said flow ports defined in said production assembly above said seal bore when said multi-position service tool is in said second position so that said central flow passage is communicated with said wellbore therethrough.

18. The apparatus of claim 17 further comprising tool retaining means for retaining said multi-position service tool in said second position in said production assembly.

19. The apparatus of claim 14 wherein said production assembly comprises a well production screen connected therein, said wash shoe being connected to said screen, and wherein said multi-position service tool includes circulation means for communicating said wellbore with said central flow passage through said production screen.

20. The apparatus of claim 19 wherein said circulation means comprises a circulation valve connected in said multi-position service tool, said central flow passage being defined therethrough, said circulation valve being movable from a sealed position to a valve circulation position, said central flow passage being communicated with said wellbore through said valve in said valve circulation position.

21. The apparatus of claim 20, said circulation valve defining a longitudinal valve passageway, said circulation valve further comprising:

an upper valve sub adapted to be connected in said service tool;

a valve housing extending downward from said upper valve sub, said housing having a longitudinal housing bore and having valve ports defined therethrough intersecting said housing bore;

a lower valve sub slidably received in said valve housing bore, said lower valve sub being adapted to be connected in said multi-position service tool and being slidable in said valve housing longitudinally from said sealed position, wherein said lower sub prevents communication through said valve ports into said longitudinal valve passageway, to said circulation position, wherein said lower valve sub slides downward longitudinally relative to said valve housing, so that communication between said longitudinal valve passageway and said well bore is established through said valve ports, said longitudinal valve passageway comprising a portion of said longitudinal central flow passage.

22. The apparatus of claim 21, wherein said circulation valve moves from said sealed to said circulation position when said multi-position service tool is moved from said first to said second position.

23. A method of gravel packing a production zone in a wellbore comprising:

lowering a gravel pack assembly into said wellbore, said gravel pack assembly comprising:

a production assembly including a packer and a liner assembly extending downward from said packer, said liner assembly including a production screen and having a wash shoe at a lower end thereof; and a multi-position service tool disposed in said production assembly, said service tool having a lower end sealingly received in said wash shoe and having a longitudinal central flow passage defined therethrough, said longitudinal central flow passage being communicated with said wellbore through said wash shoe;

circulating a washing fluid through said wash shoe and said wellbore to remove debris from said wellbore;

positioning said well production screen adjacent said production zone;

suspending said gravel pack assembly in said wellbore;

closing the wash shoe to prevent communication therethrough after said circulating step;

communicating said central flow passage with an annulus defined between said production assembly and said wellbore above said well production screen; and displacing a gravel pack fluid into said annulus through said central flow passage.

24. The method of claim 23, said wash shoe comprising an outer housing having a sealing sleeve slidably disposed therein, said multi-position service tool being releasably connected to said sealing sleeve, wherein said closing step comprises pulling said multi-position service tool upward so that said sealing sleeve engages said housing to close said shoe and prevent flow therethrough.

25. The method of claim 23 wherein said communicating step comprises aligning a crossover port defined in said service tool with a flow port defined through said liner.

26. The method of claim 25 further comprising sealing said central flow passage below said crossover port to prevent downward flow therethrough.

27. The method of claim 25 wherein said displacing step comprises directing said gravel pack fluid through said crossover ports and said flow ports into said well annulus.

28. The method of claim 25 wherein said aligning step comprises pulling said multi-position service tool upward from a first position wherein said crossover port is sealed against said liner to prevent flow therethrough to a second position wherein said crossover port aligns with said flow port.

29. The method of claim 28 further comprising retaining said multi-position service tool in said second position.

30. The method of claim 23 further comprising locking said wash shoe as to said closing step in closed position to prevent communication therethrough.

31. The method of claim 30 further comprising:

removing said lower end of said multi-position service tool from said wash shoe; and positioning said lower end of said multi-position service tool adjacent said production screen.

32. The method of claim 23 further comprising after said gravel pack has been set by displacing said gravel pack fluid into said wellbore, removing said service tool from said production assembly.

33. The method of claim 23 wherein said circulating step comprises displacing said washing fluid down an annulus between said production assembly and said wellbore, so that said fluid enters said wash shoe and is delivered to the surface through said central flow passage.

34. The method of claim 23 wherein said circulating step comprises displacing said washing fluid down said central flow passage through said wash shoe so that said fluid flows upwardly to the surface in an annulus defined between said production assembly and said wellbore.

* * * * *